US009373310B2

(12) United States Patent
Martin

(10) Patent No.: US 9,373,310 B2
(45) **Date of Patent: *Jun. 21, 2016**

(54) DRUM LUG HOLDERS PROVIDING ISOLATED RESONANCE

(71) Applicant: August D. Martin, Albuquerque, NM (US)

(72) Inventor: August D. Martin, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/621,817

(22) Filed: Feb. 13, 2015

(65) Prior Publication Data

US 2015/0161974 A1 Jun. 11, 2015

Related U.S. Application Data

(63) Continuation-in-part of application No. 14/536,606, filed on Nov. 8, 2014, which is a continuation of application No. 14/092,400, filed on Nov. 27, 2013, now Pat. No. 8,884,144, which is a continuation of application No. 13/857,924, filed on Apr. 5, 2013, now Pat. No. 8,629,340.

(51) Int. Cl.
*G10D 13/02* (2006.01)

(52) U.S. Cl.
CPC ..... *G10D 13/023* (2013.01)

(58) Field of Classification Search
CPC ..... G10D 3/02; G10D 3/00
USPC ..... 84/411 R, 413
See application file for complete search history.

(56) References Cited

U.S. PATENT DOCUMENTS

| | | | | |
|---|---|---|---|---|
| 1,212,126 | A | 1/1917 | Canfield | |
| 3,981,220 | A | 9/1976 | Clark | |
| 4,295,405 | A | 10/1981 | Sleishman | |
| 4,448,105 | A | 5/1984 | Cordes | |
| 4,520,709 | A | 6/1985 | Kester, Jr. | |
| 4,660,455 | A | 4/1987 | Jones et al. | |
| 4,714,002 | A | 12/1987 | Cleland | |
| 4,833,964 | A | 5/1989 | Prouty | |
| 4,869,146 | A | 9/1989 | Bonsor | |
| 5,410,938 | A | 5/1995 | Kurosaki et al. | |
| 5,447,087 | A | 9/1995 | Hawes et al. | |
| 5,721,389 | A * | 2/1998 | Kleindienst et al. | 84/421 |
| 5,834,667 | A | 11/1998 | Midkiff | |

(Continued)

OTHER PUBLICATIONS

International Search Report and Written Opinion for PCT/US2014/032867, Aug. 15, 2014, 17 pages.

*Primary Examiner* — Kimberly Lockett
(74) *Attorney, Agent, or Firm* — Los Angeles Patent Group; Arman Katiraei

(57) ABSTRACT

Some embodiments provide a drum structural framework comprising a top shell mount, bottom shell mount, rod holders, and tension rods. The top shell mount and bottom shell mount are mounted to either ending edge of a drum shell disposed between the two mounts. A first set of the rod holders are coupled to the top shell mount and an aligned second set of the rod holders are coupled to the bottom shell mount. The tension rods link the two sets of rod holders without hindering resonance of the drum shell. Tuning assemblies on the rod holders adjust the distance separating the top shell mount from the bottom shell mount, thereby controlling the force imposed on the drum shell. Each rod holder includes one or more dampeners that isolate energy passing from the drumhead to the shell from also reverberating throughout the structural framework of the tension rods and rod holders.

18 Claims, 36 Drawing Sheets

(56) References Cited

U.S. PATENT DOCUMENTS

| | | | | |
|---|---|---|---|---|
| 7,138,574 | B1 | 11/2006 | Spinazzola | |
| 7,491,877 | B1 | 2/2009 | Cherny | |
| 7,501,567 | B1 | 3/2009 | Spinazzola | |
| 7,960,633 | B1 * | 6/2011 | Chen | 84/413 |
| 7,960,634 | B2 * | 6/2011 | Gauger | 84/421 |
| 8,188,355 | B2 | 5/2012 | Tochilin | |
| 8,629,340 | B1 | 1/2014 | Martin | |
| 8,884,144 | B2 * | 11/2014 | Martin | 84/411 R |
| 2007/0283797 | A1 | 12/2007 | Crawford et al. | |
| 2009/0038465 | A1 | 2/2009 | Whalley et al. | |
| 2014/0026732 | A1 | 1/2014 | Spinazzola et al. | |
| 2014/0053708 | A1 | 2/2014 | Spinazzola et al. | |
| 2014/0305282 | A1 * | 10/2014 | Allen | 84/421 |

* cited by examiner

DRUM LUG HOLDERS PROVIDING ISOLATED RESONANCE

CLAIM OF BENEFIT TO RELATED APPLICATIONS

This application is a continuation-in-part of the U.S. non-provisional application Ser. No. 14/536,606, entitled "Drum Mounting and Tuning System Providing Unhindered and Isolated Resonance", filed Nov. 8, 2014 which is a continuation-in-part of the U.S. non-provisional application Ser. No. 14/092,400, entitled "Drum Mounting and Tuning System Providing Unhindered and Isolated Resonance", filed Nov. 27, 2013, now U.S. Pat. No. 8,884,144, which is a continuation of the U.S. non-provisional application Ser. No. 13/857,924, entitled "Drum Mounting and Tuning System Providing Unhindered and Isolated Resonance", filed Apr. 5, 2013, now U.S. Pat. No. 8,629,340. The contents of application Ser. Nos. 14/536,606, 14/092,400 and 13/857,924 are hereby incorporated by reference.

TECHNICAL FIELD

The present invention pertains to musical instrument structure and design and, more specifically, to drum structure and design.

BACKGROUND

Artistic expression can be conveyed in any one of several mediums including music. Musical instruments provide the tools with which to express musicality. Drums or percussions instruments in general are one such tool.

Drum structure and design has remained consistent over several generations. This consistent structure and design has preserved the sound quality that initial incarnations of the instrument produced. While standard and commonplace today, the sound produced by drums constructed according to the conventional structure and design is one that is deadened or muted. This is because of structural features that are integrated into the drum shell that impede the shell's ability to resonate and produce a full and rich sound.

FIG. 1 illustrates drum structure and design common in the prior art. The drum is composed of a pair of drum hoops or rims, a shell, a set of lugs, and a corresponding set of lug holders attached across the side of the drum shell.

The interior of each hoop contains the drumhead. The drumhead is the contact surface that vibrates when stricken during play. For a typical drum, the drumhead on the top side of the drum, sometimes called the batter head, is the part of the drum that a drummer strikes when playing the instrument. The drumhead on the bottom side of the drum provides resonance and is usually thinner than the drumhead on the top side.

Tuning assemblies on the drum hoop can be used to adjust the tension on the drumhead, thereby tuning the drumhead sound and also allowing different drumheads to be coupled to the shell mount. The drum hoop also contains various openings through which the set of lugs can pass through to connect to the corresponding set of lug holders that are attached across the side of the drum shell.

The shell is the body of the drum. It creates much of the sound characteristics of the drum based in part on the resonance of the materials from which the drum shell is constructed. When the drumhead is impacted, the drumhead vibrates. When the drum hoop is tightly coupled to the drum shell using the lug fastening system, the vibrations channel from the drumhead to the containing hoop and are dispersed across the shell. These vibrations then cause the drum shell to resonate which, in turn, produces some of the drum's sound characteristics. Often, the drum shell includes a small hole referred to as the vent hole. The vent hole allows air to escape when the drum is struck, which in turn improves the resonance of the drum.

However, conventional drum structure and design as shown by FIG. 1 impedes this resonance. This is due to the attachment of the lug holders 110 across the drum shell. Specifically, when the lugs are placed into the lug holders and tightened in order to couple the drum hoop to the shell, a force is exerted on the lug holders based on how tightly the lugs are tightened. The force is then borne onto the drum shell along the points at which the lug holders are connected to the shell. This force pulls the drum shell in at least one direction, preventing the drum shell from fully resonating in the opposite direction(s), and thereby deadening or muting the overall sound produced by the drum.

Conventional drum structure and design further hinders the sound that can be produced by the drum by limiting the current manufacturing and production of the drum shell to dense materials such as metal (e.g., steel or brass), wood (e.g., birch, maple, oak, etc.), and acrylic as some examples, to thicker construction, or some combination of both. The density of the drum shell material and thickness of the drum shell are needed to prevent the drum shell from warping or breaking when absorbing and counteracting the forces imposed by the tensioning of the lugs from the drum hoop to the lug holders attached along the side of the drum shell. This results in a lot of force on the drum shell. It is for this reason that some shells are manufactured with a thickness of up to 20 millimeters. In these instances, more energy is needed to induce resonance from such shells. Also, the density and thickness causes the drum shell to vibrate at a higher intrinsic frequency. Accordingly, the sound profile produced by the drum is defined and limited to the resonate characteristics that these dense or thicker materials provide. The full potential spectrum of a drum shell's sound is unattainable unless a drum shell of reduced thickness or less dense materials are used in the drum shell composition and the drum shell is allowed to resonate freely. Both of these attributes would require less sound energy from a stricken drumhead to generate resonation from a drum shell. Thus, this would provide a drum a more efficient resonating sound profile.

In an attempt to remedy some of these shortcomings, alternative drum designs have been proposed. One such alternative design is provided in U.S. Pat. No. 5,410,938. The provided design frees the resonance of the drum shell by use of tension rods that span from the top side drum hoop (i.e., batter side) to the bottom side drum hoop and by coupling the rod holders to the hoops instead of the drum shell. This design improves the potential resonate characteristics of the drum shell, but does so by imposing other tradeoffs in the sound quality of the drum. Specifically, this design produces a distorted and impure sound because vibrations from the drumhead disburse not only across the drum shell but also into each of the tension rods. Consequently, the tension rods absorb vibrations each time the drumhead is struck causing the tension rods to produce additional undesired sounds (i.e., rattling) along with the expected drum sound. These undesired sounds are the result of a failure to isolate the mounting or tuning mechanisms (i.e., tension rods and rod holders) from the sound producing elements of the drum (i.e., drumhead and shell).

Accordingly, there is a need for a new drum structure and design that provides pure and unimpeded sound by allowing the drum shell to resonate freely without distortion or dampening from mounting or tuning mechanisms attached across the side of the drum shell. In other words, there is a need for a new drum structure and design wherein the supporting framework couples together the sound producing elements of the drum in a manner that shields the sound energy emanating from the sound producing elements from the supporting framework. By addressing these needs, one can produce a drum with unparalleled sound. Drum design can further improve the sound profile of the drum by addressing the need to reduce the forces that are imposed on the drum shell. In so doing, such a design would allow for shells constructed from thinner materials to be incorporated into the drum construction with the drum shell offering greater resonance and different sound characteristics than their thicker or more dense counterparts.

SUMMARY OF THE INVENTION

It is an objective to provide a drum structural framework that disburses energy from the drumhead to a freely resonating drum shell while reducing or completely isolating the same energy from reverberating throughout the structural framework. It is therefore an objective to provide a drum structural framework that achieves a pure drum sound profile in which the resonance of the drum shell is unimpeded and distortion and other undesired sounds from the structural framework are eliminated.

These and other objectives are achieved by the ultimount structural framework of some embodiments. The ultimount structural framework is comprised of a top shell mount, bottom shell mount, rod holders, and tension rods. Unique to the ultimount rod holders is the integrated dampening solution that contains the energy imposed during play on the sound producing elements while reducing or completely isolating that same energy from reverberating through the non-sound producing elements of the structural framework.

The top shell mount comprises a die-cast hoop, a bearing edge ring, and a tension ring. The top shell mount secures and tunes a first drumhead of the drum to the drum shell without hindering resonance of the drum shell. The bottom shell mount comprises a complementary die-cast hoop, bearing edge ring, and tension ring that secures and tunes a second drumhead also without hindering resonance of the shell. Specifically, a first set of the rod holders are coupled to the top shell mount and an aligned second set of the rod holders are coupled to the bottom shell mount. The tension rods link the first set of the rod holders to the corresponding second set of rod holders. Tuning assemblies on the rod holders can be used to adjust the distance separating the top shell mount from the bottom shell mount, thereby controlling the compression force imposed on the drum shell. The compression force holds the drum shell in place without hindering resonance of the drum shell, because the drum shell itself is only contacted along its top and bottom distal edges by the underside of the top shell mount and the bottom shell mount. The free resonance of the drum shell produces a richer and fuller sound profile as compared to other designs in which extraneous forces placed on the drum shell deaden the sound by obstructing the resonance of the drum shell. These extraneous forces typically manifest when lug holders or other forces are disposed along the side of the drum shell. An additional undesired byproduct of these extraneous forces is the need for a thicker drum shell. The greater the thickness of the drum shell, the greater the amount of energy needed to induce resonance and produce sound. However, since the design advocated herein removes any such extraneous forces from the drum shell, thinner drum shells or drum shells using less dense materials that were previously inapt, such as plastic, clay, and glass, can now be used. Consequently, a new evolution in drum sound is opened.

Moreover, each rod holder couples to either the top shell mount or bottom shell mount with one or more isolation rings that serve as vibration dampeners. The dampeners isolate energy passing from the drumhead to the drum shell from also reverberating throughout the structural framework of the tension rods and rod holders holding together the drumhead and drum shell. This prevents the tension rods and other structural framework elements from vibrating or creating other undesired sound or reverberation that would otherwise pollute the sound profile of the drum.

BRIEF DESCRIPTION OF THE DRAWINGS

In order to achieve a better understanding of the nature of the present invention a preferred embodiment of the ultimount structural framework will now be described, by way of example only, with reference to the accompanying drawings in which.

DETAILED DESCRIPTION OF THE INVENTION

Figure 1:
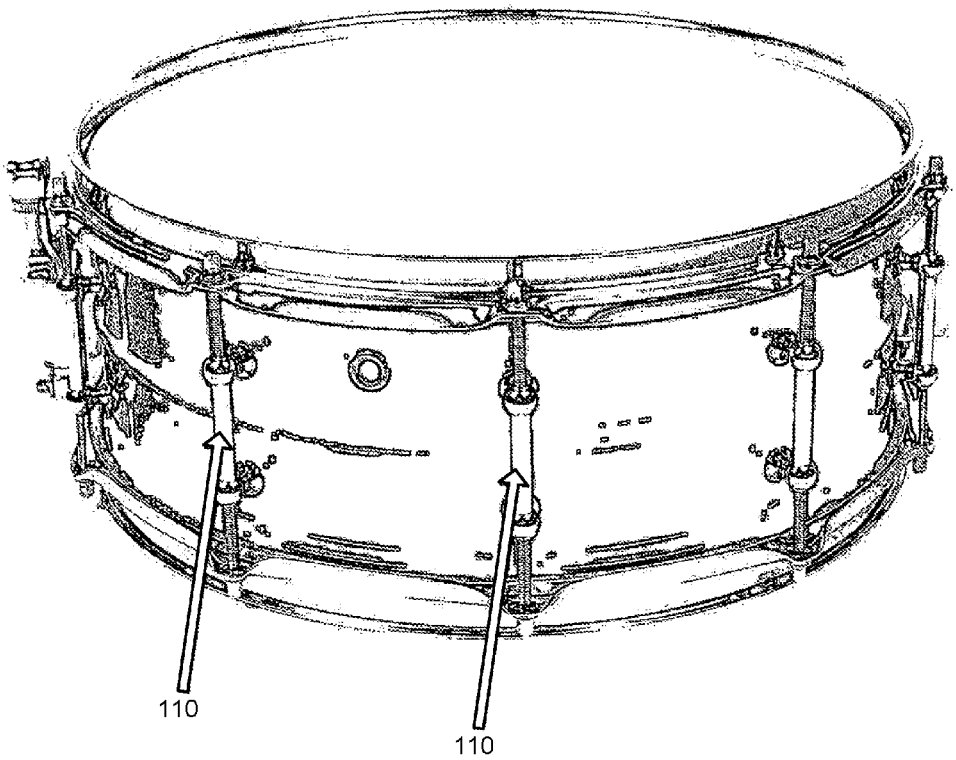
Prior Art Figure 1
FIG. 1 illustrates drum structure and design commonplace in the prior art.
Figure 2:
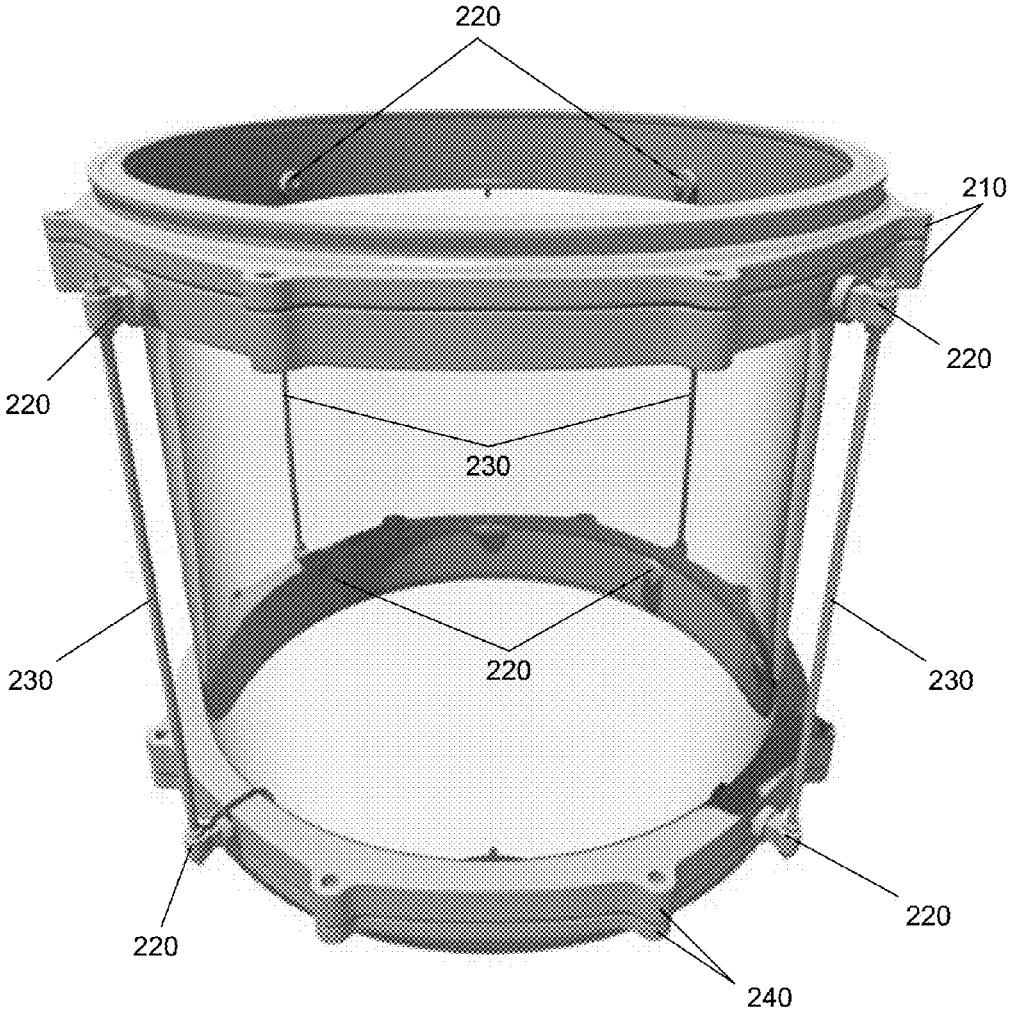
FIG. 2 illustrates the ultimount drum design and structure of some embodiments.

FIG. 2 illustrates the ultimount drum design and structure of some embodiments. In differing from drum designs and structures of the prior art, the ultimount couples the drumhead to the drum shell in a manner that does not hinder resonance of the drum shell and in a manner that isolates the non-sound producing supporting framework from the sound producing drumhead and shell. In so doing, the ultimount provides several advantages over drum designs and structures of the prior art. First, the ultimount provides a richer and fuller sounding drum because the ultimount does not hinder resonance of the drum shell during play. Second, the ultimount eliminates undesired sound and distorted sound from the overall sound profile of the drum because of the isolation of the structural framework from the sound producing elements of the drum. Third, the ultimount allows for the manufacture of entirely new drum shells because the ultimount removes extraneous forces that are imposed on the drum shell by other frameworks, thereby allowing the drum shell to be manufactured with thinner construction and/or less dense materials, thus providing better resonance.

As shown in FIG. 2, the ultimount structural framework includes top shell mount 210, rod holders 220, tension rods 230, and bottom shell mount 240. This structural framework couples the drumhead to the shell. More importantly, this structural framework ensures that sound energy imposed on the drumhead during play is disbursed to an unhindered and freely resonating drum shell without reverberating throughout the structural framework and without causing distorted or undesired sound.

Figure 3:
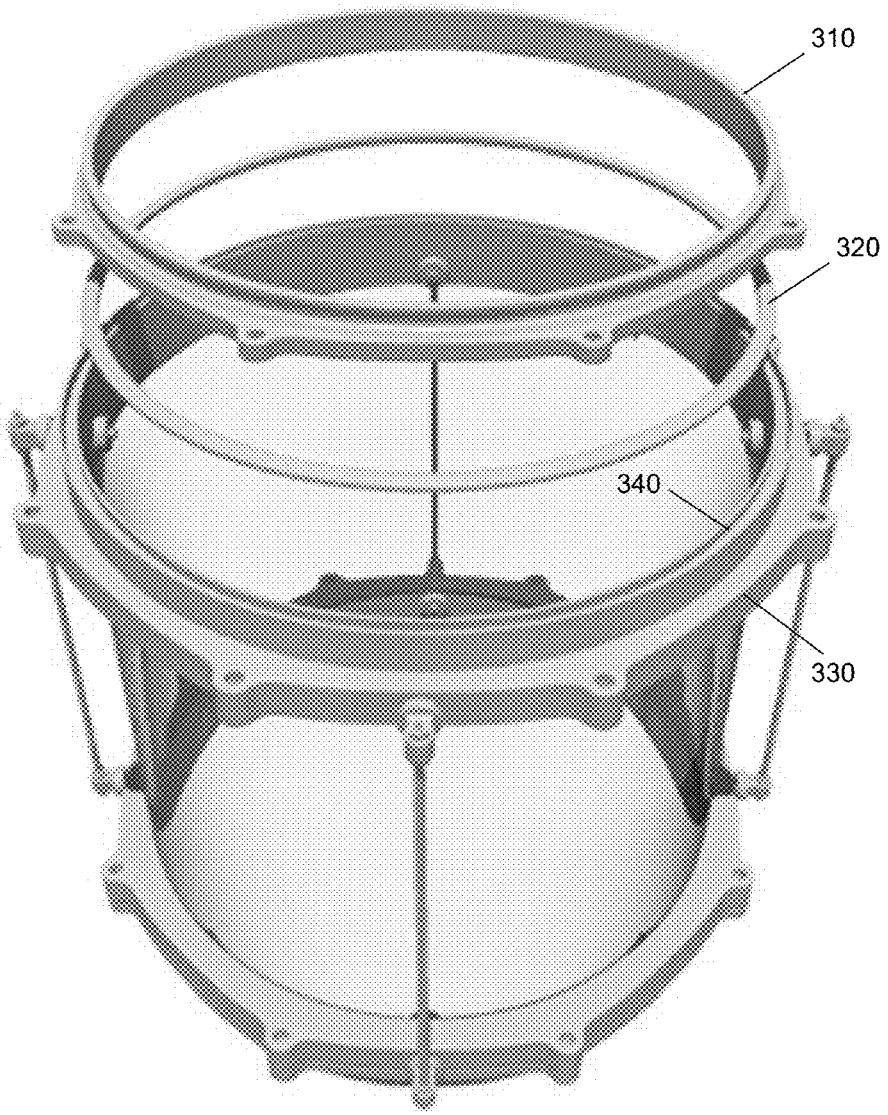
FIG. 3 provides a partially exploded view of the ultimount structural framework to illustrate the die-cast hoop, bearing edge ring, and tension ring of the top shell mount.
Figure 4:
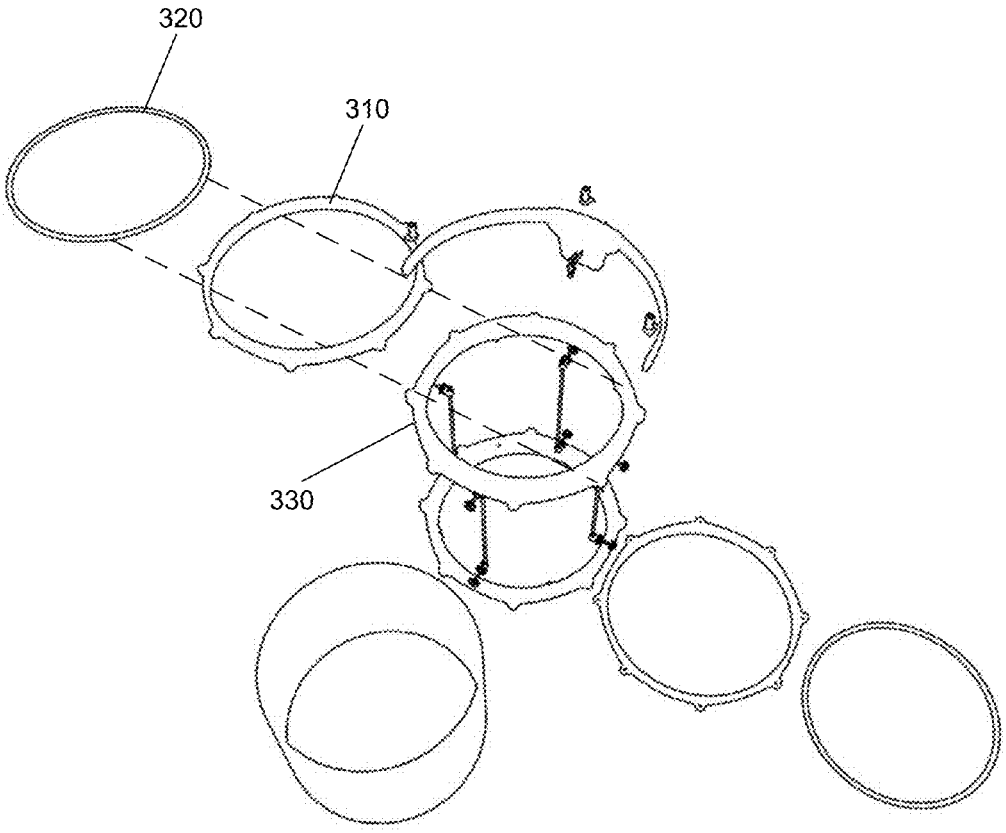
FIG. 4 provides an alternate exploded view illustrating the die-cast hoop, bearing edge ring, and tension ring of the top shell mount.

The top shell mount 210 and bottom shell mount 240 are constructed from a rigid material, such as metal (e.g., brass, steel, etc.) or carbon fiber. Each shell mount 210 and 240 is comprised of a die-cast hoop, a bearing edge ring, and a tension ring. FIG. 3 provides a partially exploded view of the ultimount structural framework to illustrate the die-cast hoop 310, bearing edge ring 320, and tension ring 330 of the top shell mount 210. FIG. 4 provides an alternate exploded view illustrating the die-cast hoop 310, bearing edge ring 320, and tension ring 330 of the top shell mount 210. For simplicity, the die-cast hoop is interchangeably referred to as the upper ring and the tension ring is interchangeably referred to as the lower ring.

The lower ring or tension ring 330 mounts atop the outer lip of the drum shell. The tension ring 330 has a hollowed inner cavity with a recessed groove 340 running centrally along the ring circumference.

Figure 5:
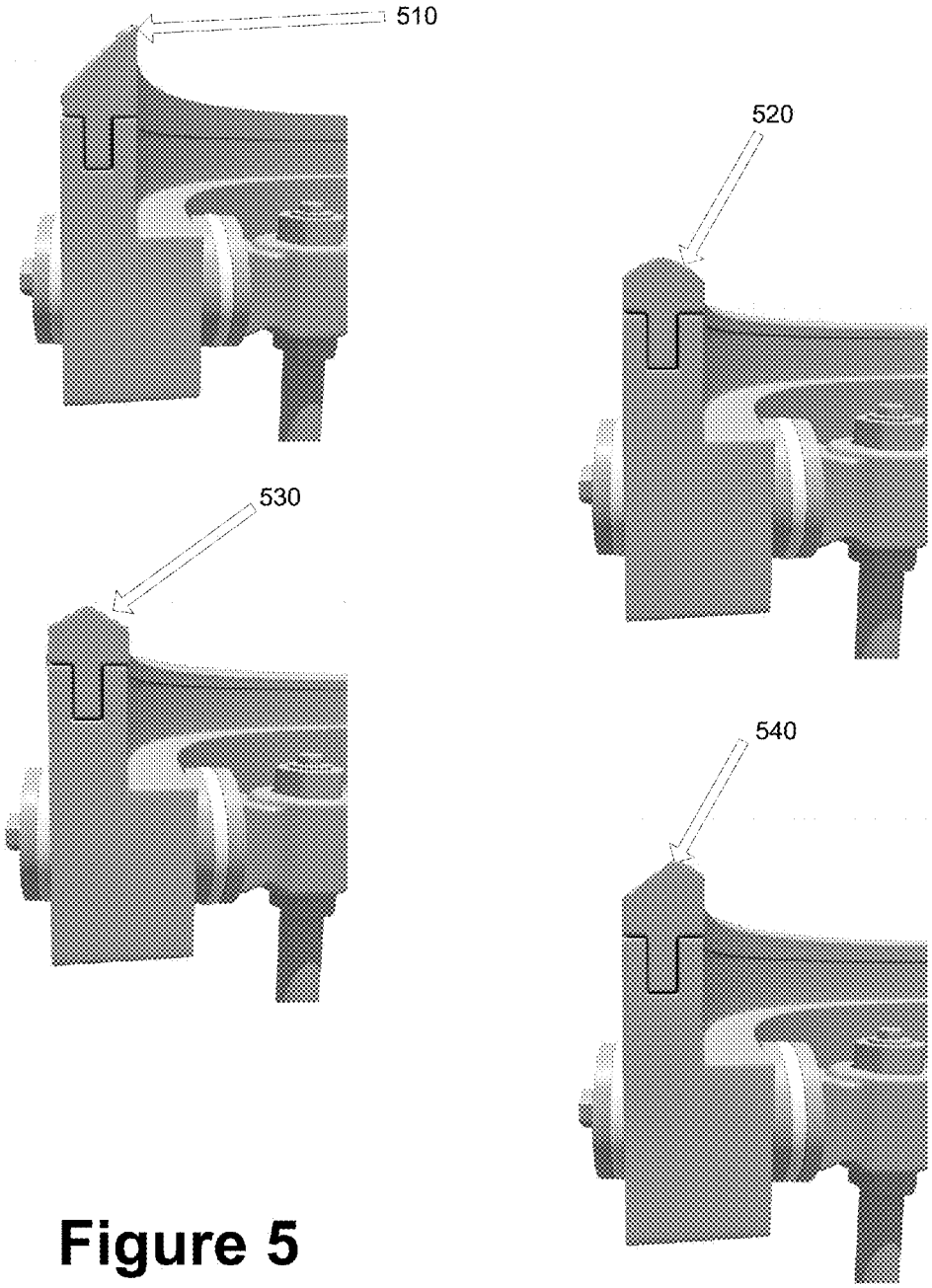
FIG. 5 provides cross sectional views of different bearing edge rings that can be inserted within the tension ring with each bearing edge ring cut at a different angle in accordance with some embodiments.

The bearing edge ring 320 has a downward extruding edge that allows the bearing edge ring 320 to sit within the recessed groove of the tension ring 330 and to aid in precise drum tuning. As such, the bearing edge ring 320 is easily interchangeable, thereby allowing the ultimount framework to accommodate bearing edges that are cut at a variety of angles with each angle changing the tonality of the drum, and more generally, altering the sound profile. Some embodiments provide a bearing edge cut at 30 degrees and other embodiments provide a bearing edge cut at 45 degrees. When the drumhead is disposed atop the 30 degree bearing edge, tuned, and played, the resulting sound has a mellow attack and a low amount of sustain, whereas when the drumhead is disposed atop the 45 degree bearing edge, tuned, and played, the resulting sounds has a lot of attack and a lot of sustain. These angles are provided for exemplary purposes. Accordingly, the ring 320 is not limited to these angles and can be cut at any other angle. FIG. 5 provides cross sectional views of different bearing edge rings 510, 520, 530, and 540 that can be inserted within the tension ring with each bearing edge ring 510, 520, 530, and 540 cut at a different angle in accordance with some embodiments.

The interchangeability of the bearing edge ring 320 within the tension ring 330 provides the user with quick, simple, and cost-effective means with which to alter the sound profile of the drum. The interchangeability also allows a first bearing edge ring cut at a first angle to be inserted within the tension ring of the top shell mount and a second bearing edge ring cut at a second different angle to be inserted within the tension ring of the bottom shell mount. The bearing edge ring 320 can be made of steel, brass, wood, or carbon fiber as some examples.

As noted above, the drumhead is disposed atop the bearing edge ring 320 and the upper ring or die-cast hoop 310 is placed over the drumhead and secured to the tension ring 330. Typically, the die-cast hoop 310 is enlarged relative to the tension ring 330 so as to fit around the outer circumference of the tension ring 330. Tension on the drumhead is adjusted by tightening or loosening a set of screws or lugs that pass through holes along the die-cast hoop 310 and screw into a corresponding set of threaded holes along the outer edge of the tension ring 330. Examples of these threaded holes are illustrated in FIG. 2 by reference markers 250. The tighter the die-cast hoop 310 is secured to the tension ring 330, the greater the force that is exerted on the drumhead. Adjusting this force controls how taut the drumhead becomes, thereby tuning the sound of the drumhead. In some embodiments, a torque wrench can be used to tighten the screws or lugs and thereby achieve a desired level tension on the drumhead. Different drumheads can be inserted between the top shell mount 210 and the bottom shell mount 240. As such, the drum can be played as a "tom" at one end or drumhead at the top side or batter side of the drum and as a "snare" at the other end for example.

Figure 6:
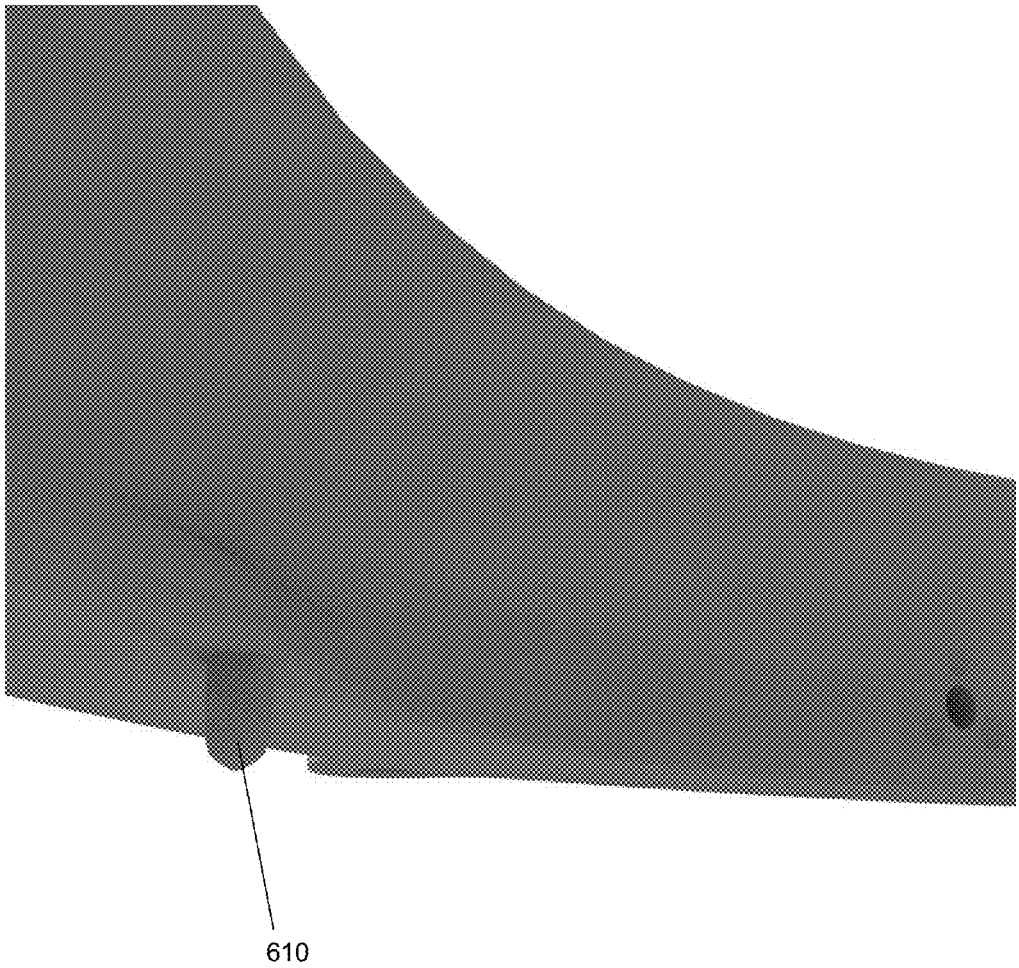
FIG. 6 illustrates a tension ring with at least one guide.

In some embodiments, the tension ring 330 includes one or more guides to aid in coupling the shell mount to the drum shell. FIG. 6 illustrates a tension ring with at least one guide 610. The guide 610 is a protrusion extending from the underside of the tension ring interior. The guides are used to align the tension ring directly over the drum shell by positioning along the interior of the drum shell circumference.

The tension ring 330 or lower ring of each shell mount 210 and 240 serves a dual purpose. As noted above, the first purpose involves coupling with the die-cast hoop 310 to hold and tune the drumhead. The second purpose involves coupling the drumhead to the drum shell in order to disburse sound energy from the drumhead to the drum shell while preventing that same energy from reverberating throughout the structural framework. The sound energy isolation is achieved based on the design and structure with which the vibration is isolated from the rod holders 220 and tension rods 230 coupled to the tension ring 330 of each shell mount 210 and 240.

In some embodiments, the tension ring 330 has a width and height of 5 to 30 millimeters such that when the tension ring 330 is positioned over the end edge of the drum shell, the tension ring 330 extends some millimeters over the plane of the end edge and away from the center of the shell. In some other embodiments, the tension ring 330 extends vertically below the plane of the end edge and towards the center of the drum shell based on a covering that protrudes from the tension ring 330 at a radius greater than that of the shell rim. In either configuration, multiple apertures are drilled across the circumferential face of the tension rings.

With reference back to FIG. 2, a first set of the rod holders 220 couple to the tension ring of the top shell mount 210 at the provided apertures. Similarly, a second set of the rod holders 220 couple to the tension ring of the bottom shell mount 240 at the provided apertures. The rod holders 220 are unique relative to those of the prior art because of their vibration isolating design and structure. The holders 220 reduce or completely isolate energy that is imposed on the drumhead during play from the structural framework holding the drum together and more specifically, from the tension rods 230. This prevents the tension rods 230 from rattling or creating other undesired sound during play.

Figure 7:
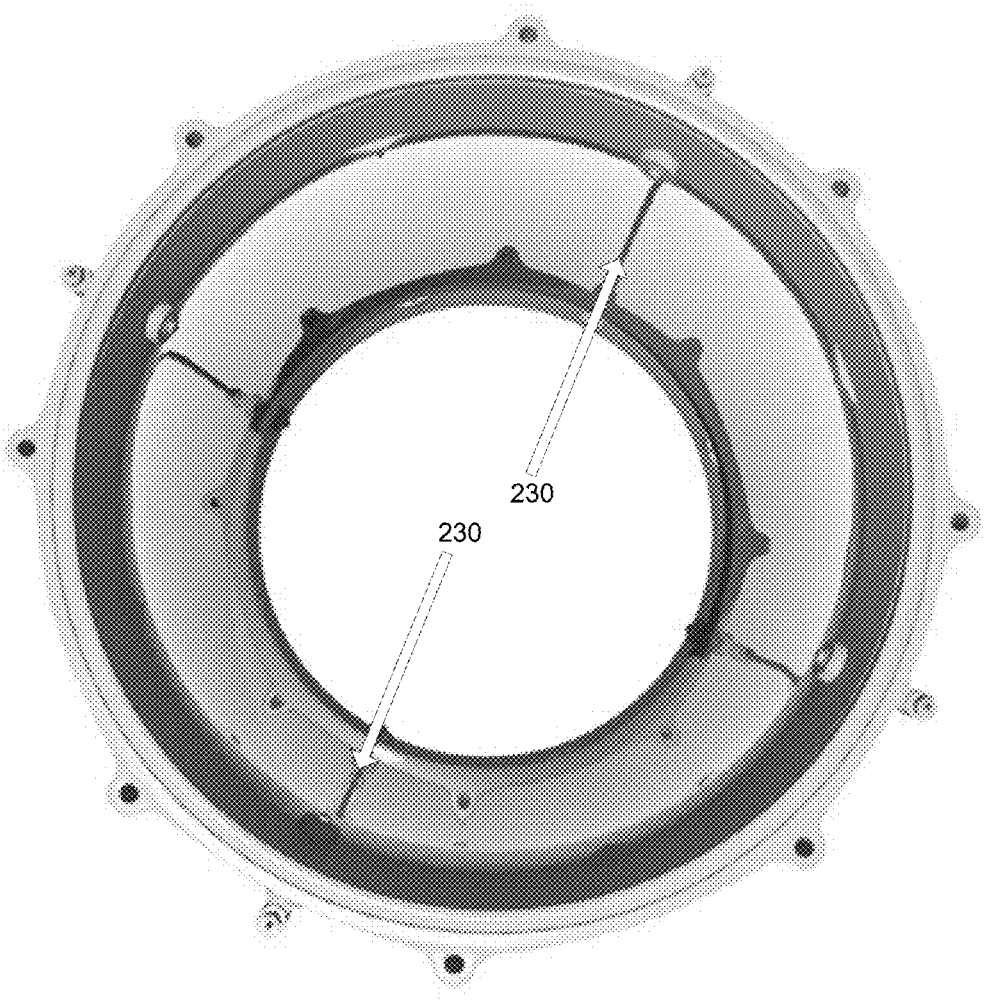
FIG. 7 illustrates the ultimount drum design and structure with a set of interior facing rod holders that dispose the tension rods within the interior of the drum shell.

In the embodiment shown in FIG. 2, the rod holders 220 are exterior facing such that the tension rods 230 span lengthwise along the exterior of the drum shell. However, other embodiments, such as the one depicted in FIG. 7, comprise a structural framework in which the rod holders 220 are interior facing such that the tension rods 230 span lengthwise within the interior of the drum shell.

Figure 8:
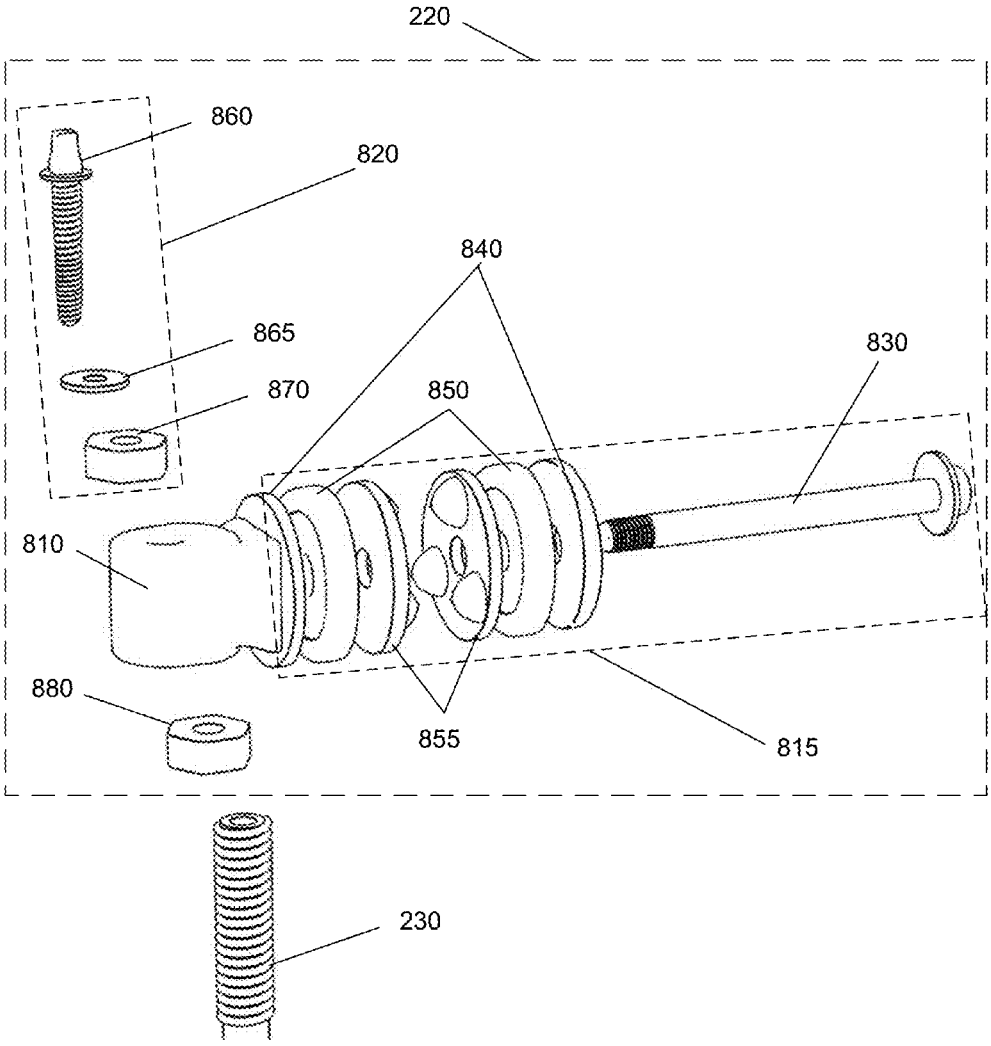
FIG. 8 illustrates an exploded view of a rod holder in accordance with some embodiments.

An exploded view of a rod holder 220 in accordance with some embodiments is provided in FIG. 8 to demonstrate the structural elements that isolate sound energy from reverberating through the ultimount structural framework. As shown, the rod holder 220 is composed of a three faceted binding anchor 810, a vibration dampening assembly 815, and a tension assembly 820.

The three faceted binding anchor 810 includes a horizontal threaded aperture that is used in conjunction with the vibration dampening assembly 815 to secure the rod holder 220 to one of the shell mounts and to isolate the structural framework from the drumhead and drum shell. The three faceted binding anchor 810 also includes bilateral vertical apertures. One end of the bilateral vertical aperture accepts a tension rod 230. The tension rod 230 passes through to the other end where it is then secured using a threaded nut 870 of the tension assembly 820.

The vibration dampening assembly 815 includes a bolt 830, spacers 840, dampeners 850, and gripped endcaps 855. In some embodiments, the endcaps 855 and spacers 840 are made from metal for structural integrity or carbon fiber for high tensile strength. The dampeners 850 are made from absorbing and dampening materials. In some embodiments, the dampeners 850 are isolating rings made of rubber, although other materials such as carbon fiber can also be used. In some other embodiments, the endcaps 855 and spacers 840 are also made from absorbing and dampening materials to compliment the dampening provided by the isolating ring dampeners 850.

The vibration dampening assembly 815 secures the rod holder 220 to one of the shell mounts 210 and 240 and, more importantly, prevents the impact energy that is placed on the drumhead from passing through the ultimount structural framework that holds the drum together. To do so, a gripped endcap 855 is positioned on either side of an aperture along the circumferential face of one of the tension rings. Each gripped endcap 855 includes a set of conical protrusions that minimize the surface contact with the circumferential face of the tension ring. Minimizing the contact surface between the gripped endcaps 855 and the circumferential face minimizes the amount of energy that gets transferred to the structural framework, thereby minimizing the amount of energy that must be dampened within the structural framework. Also, by minimizing the amount of energy that gets transferred to the structural framework, more of the energy is preserved and passed to the drum shell resulting in fuller and less muted sound. In some embodiments, the circumferential face of the tension ring includes a set of recessed guides for the set of conical protrusions of the endcaps 855. A dampener 850 in the form of an isolating ring or bushing is positioned along the opposite side of either gripped endcap 855. Lastly, a spacer 840 is positioned on either side of the dampeners 850. In some embodiments, each of the endcaps 855, dampeners 850, and spacers 840 can be convex or concave in shape depending on whether it is positioned along the interior or exterior of the tension ring.

Each of the endcaps 855, dampeners 850, and spacers 840 has a circular opening in their respective center that is sized to accommodate the bolt 830. Once the elements are positioned, the bolt 830 is passed through each of the elements with the aperture of the tension ring being at the center of the arrangement. The bolt 830 is screwed into the horizontal threaded aperture of the three faceted binding anchor 810. This then secures the rod holder 220 to the tension ring of either the top shell mount 210 or bottom shell mount 240. Furthermore, it establishes the necessary contact to allow the dampeners 850 to absorb and prevent energy from passing into the structural framework.

The endcaps 855, dampeners 850, and spacers 840 are also sized according to the radial height of the tension ring to which they are attached. In some embodiments, the radial height changes based on the drum shell size (or diameter) and the corresponding size of the shell mount that fits the drum shell. The different sized endcaps 855, dampeners 850, and spacers 840 ensure proper dampening by providing sufficient contact between the tension ring and the vibration dampening assembly 815 while avoiding components that are over-sized such that they extend beyond the radial height of the tension or are undersized such that they pass through rather than engage the aperture along the circumferential face of the tension ring. This also ensures that the conical protrusions of the endcaps 855 fit within the recessed guides along the circumferential face of the tension ring when the guides are present.

Figure 9:
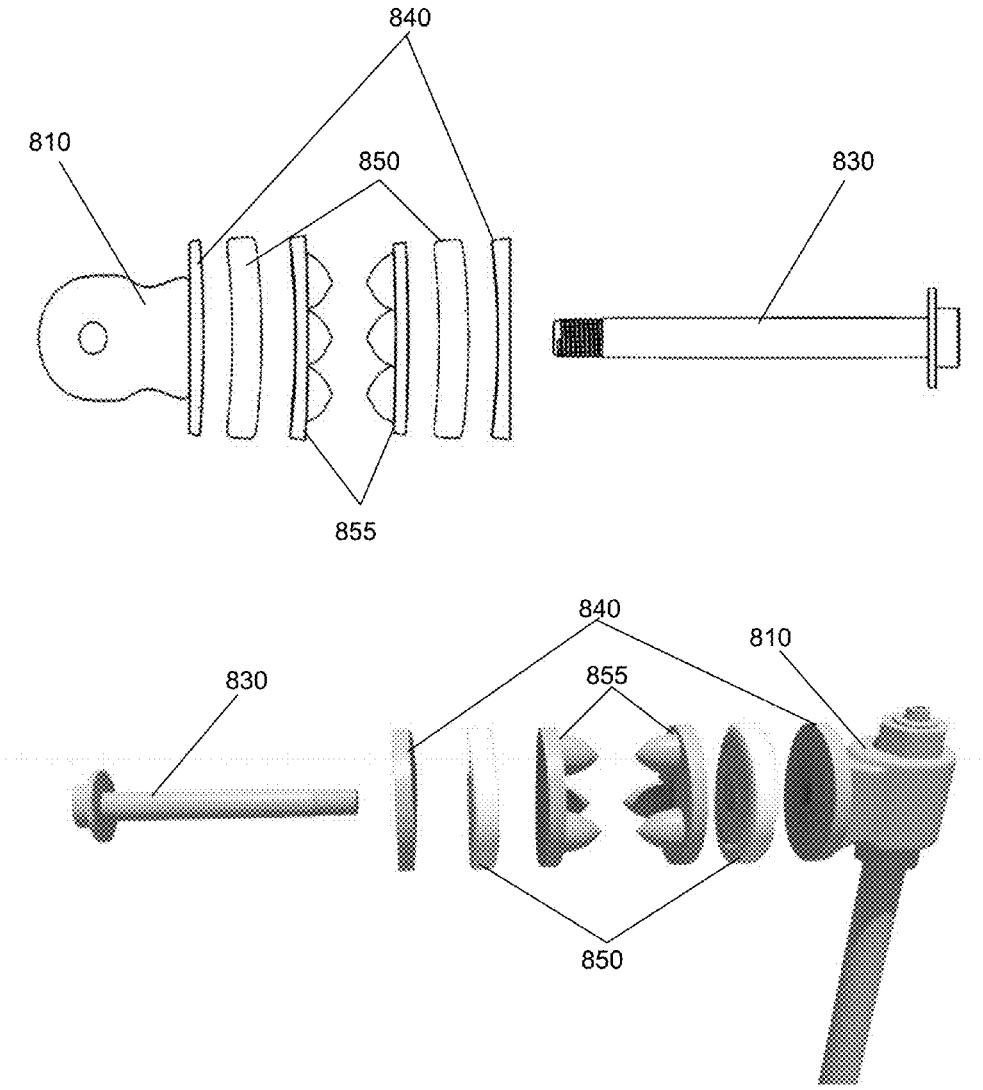
FIG. 9 provides another exploded view for the vibration dampening assembly of some embodiments.
Figure 10:
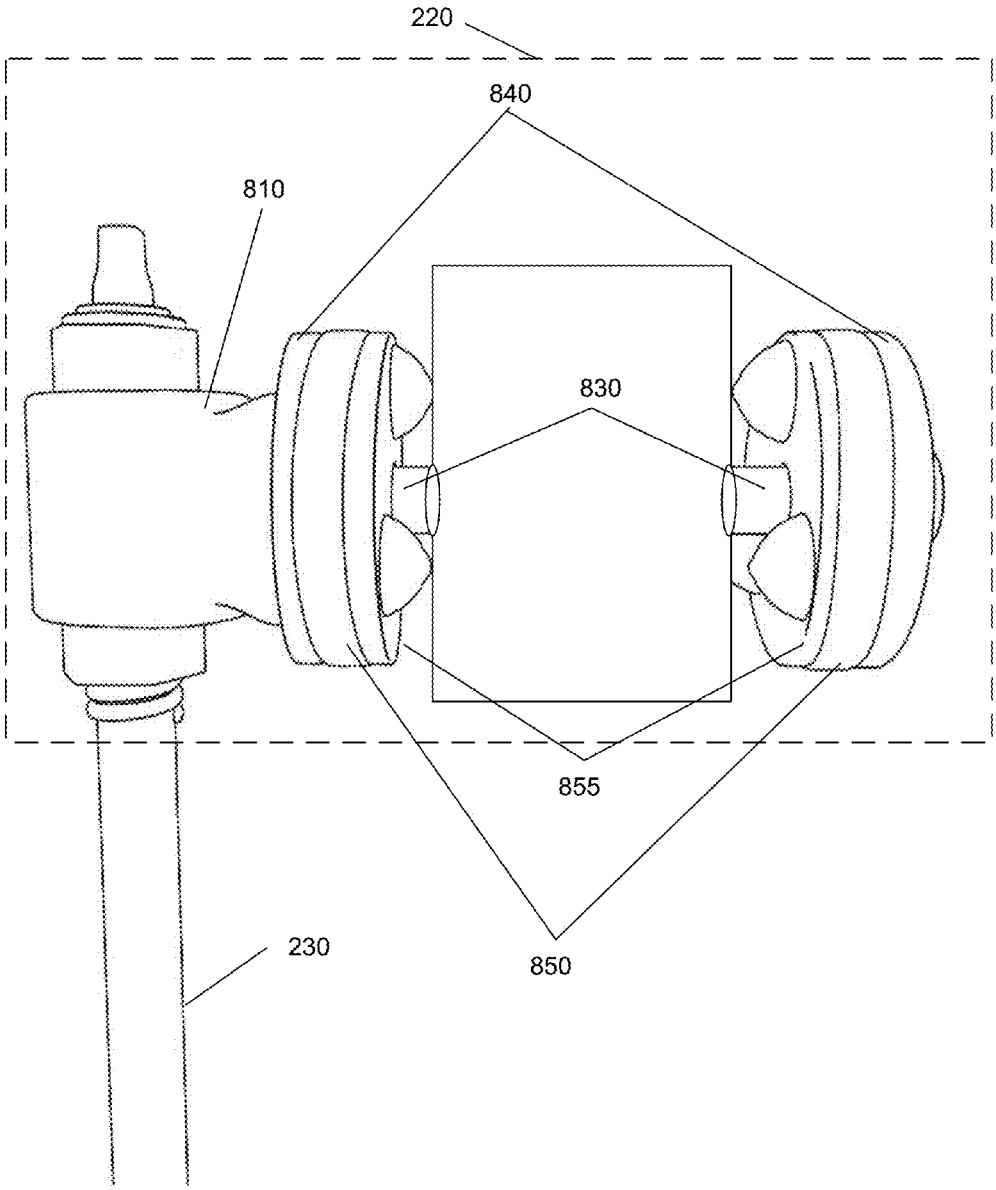
FIG. 10 illustrates a completed vibration dampening assembly.
Figure 11:
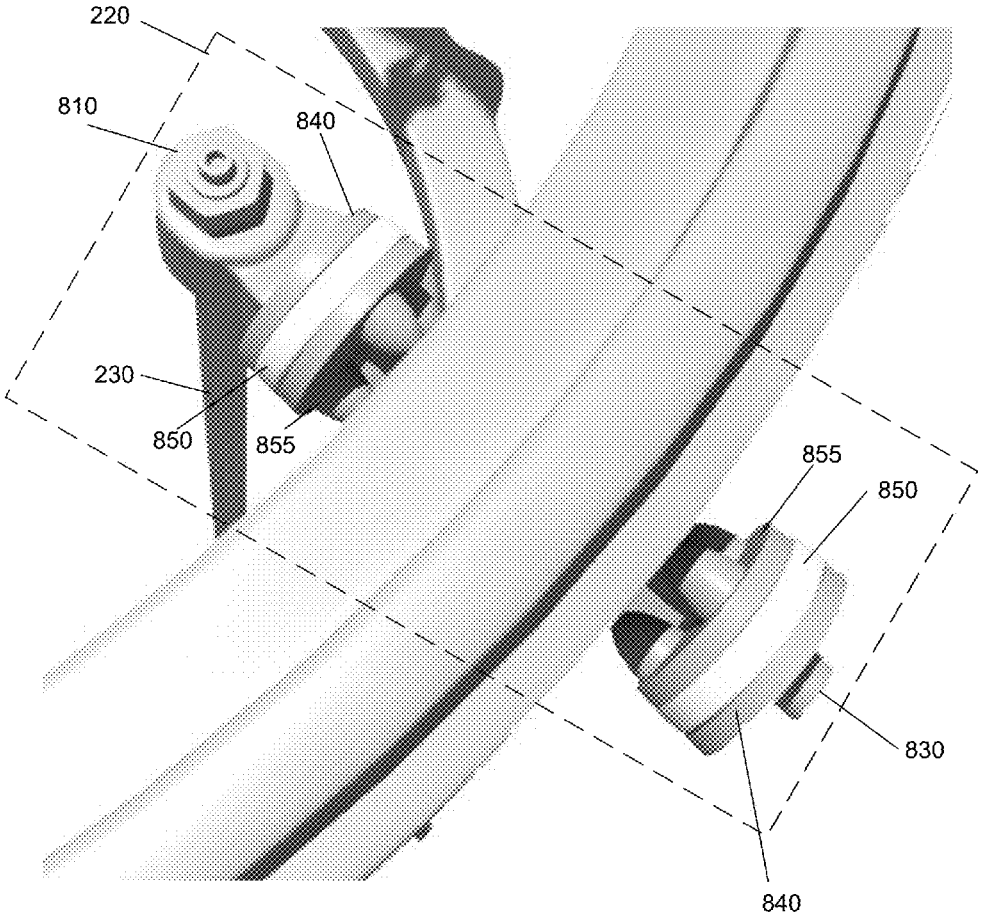
FIG. 11 provides an alternate rendering for a completed vibration dampening assembly secured to one of the shell mounts in accordance with some embodiments.

FIG. 9 provides another exploded view for the bolt 830, spacers 840, dampener 850, and gripped endcaps 855 that comprise the vibration dampening assembly 815 of the rod holders 220. FIG. 10 illustrates a completed vibration dampening assembly secured to one of the shell mounts 210 or 240. FIG. 11 provides an alternate rendering for a completed vibration dampening assembly secured to one of the shell mounts 210 or 240 in accordance with some embodiments.

Figure 12:
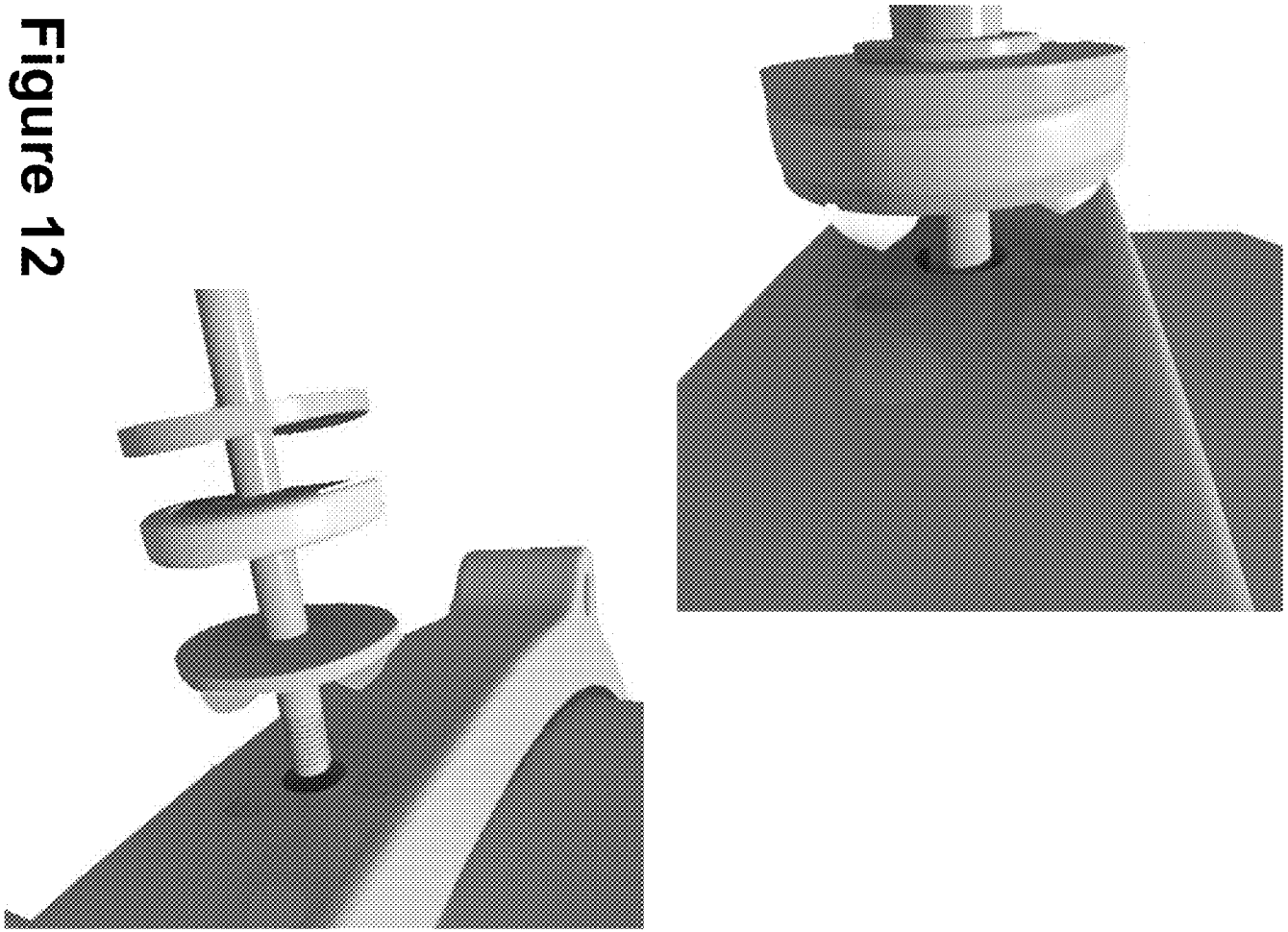
FIG. 12 provides two views illustrating an oversized tension ring aperture in accordance with some embodiments.

In some embodiments, the aperture of the tension ring is slightly larger than the bolt 830. The additional spacing in the tension ring aperture allows air to escape when the drum is struck, thereby providing venting and improved resonance. In some embodiments, the circumferential face of FIG. 12 provides two views illustrating an oversized tension ring aperture in accordance with some embodiments.

Figure 13:
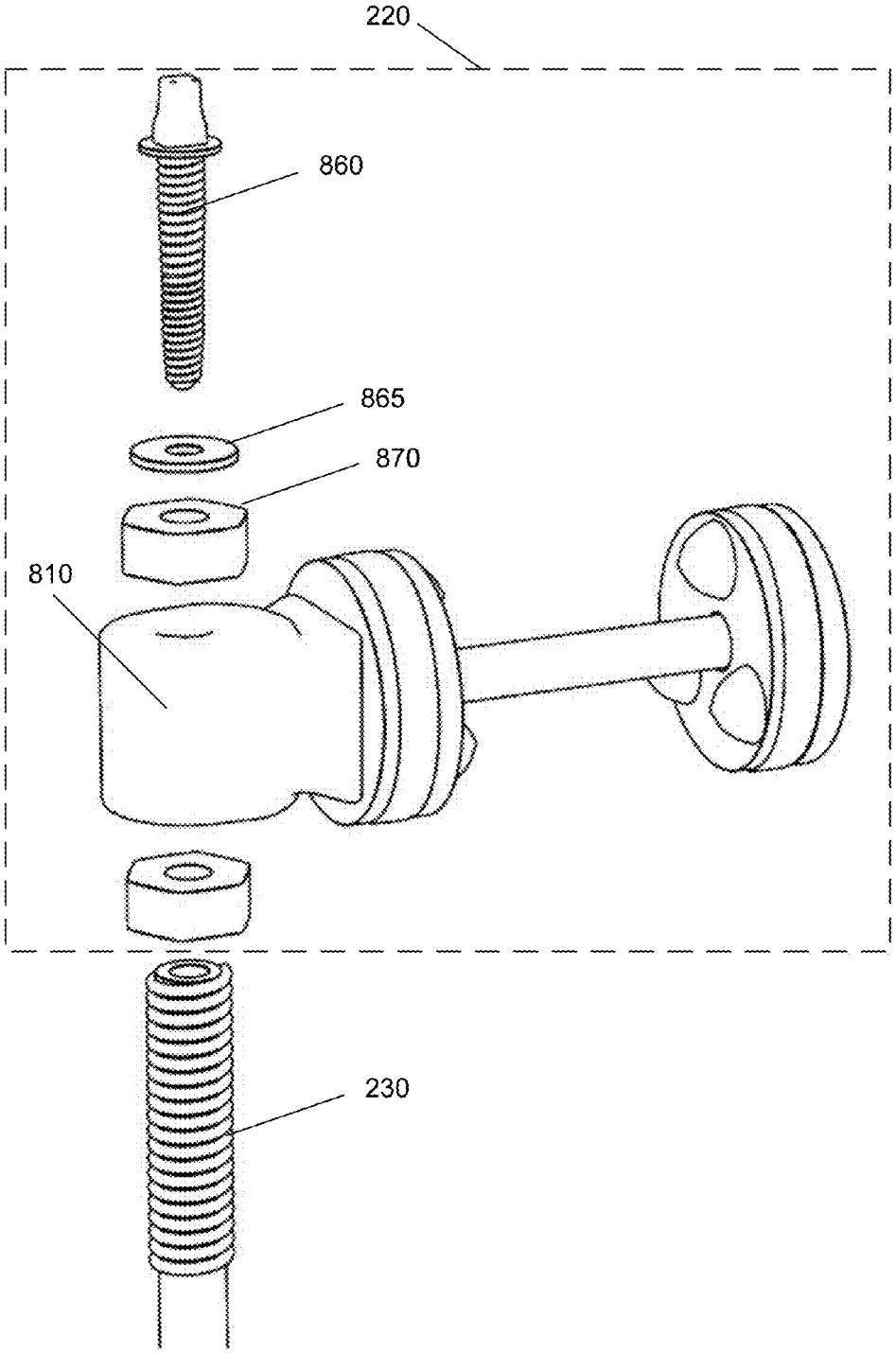
FIG. 13 illustrates an exploded view for the tension assembly of some embodiments.
Figure 14:
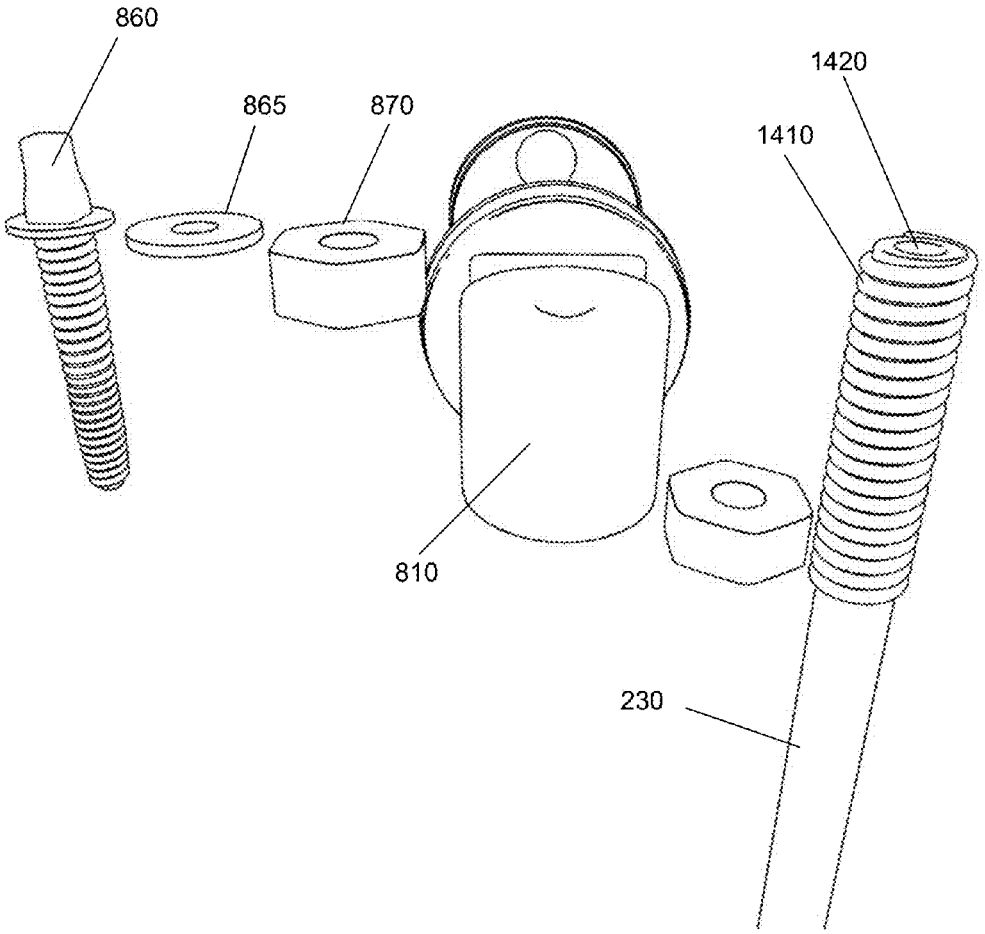
FIG. 14 provides an alternative staggered exploded view for the tension assembly of some embodiments.

With reference back to FIG. 8, the tension assembly 820 is comprised of a top bolt 860, a washer 865, and a threaded nut 870. FIG. 13 illustrates an exploded view for the tension assembly 820 of some embodiments. FIG. 14 provides an alternative staggered exploded view for the tension assembly 820 of some embodiments. The tension assembly 820 operates in conjunction with the three faceted binding anchor 810 and a tension rod 230 to secure the drum shell between the top shell mount 210 and the bottom shell mount 240 of the ultimount.

In some embodiments, each tension rod 230 is a hollowed shaft that contains an exterior thread and an interior thread at either end of the rod. In some embodiments, the tension rods 230 are made from metal, carbon fiber, or other rigid materials. Reference marker 1410 of FIG. 14 illustrates the exterior thread and reference marker 1420 points to the location of the interior thread. This configuration creates a two stage male-female coupling mechanism with which the tension rod 230 attaches and is secured to the anchor 810.

To complete the first stage of the male-female coupling mechanism, the exterior threaded end of the tension rod 230 screws through a first threaded nut 880, passes through a vertical aperture of the anchor 810, and is then secured at the other end of the anchor 810 with a second threaded nut 870. Completion of the first stage provides a loose coupling of the tension rod 230 to the anchor 810, thereby securing the tension rod 230 to the shell mount that the rod holder for the anchor is coupled to. The other exterior threaded end of the tension rod 230 is similarly secured to a rod holder that is coupled to the opposing shell mount using a complimentary second threaded nut 870. When the nuts 870 are tightened, the distance separating the shell mounts 210 and 240 is reduced, thereby compressing the drum shell disposed between the mounts 210 and 240. In some embodiments, the tension rod 230 can be screwed via nut 870 such that the end of the tension rod 230 is at least four centimeters away from the top of the anchor, thereby allowing for the distance between the two linked shell mounts 210 and 240 to differ by a total of eight centimeters. The distance separating the shell mounts 210 and 240 and the desired compression forced placed on the drum shell disposed in between can be specifically dialed using a torque wrench to tighten the nut 870. This customizability optimizes the ultimount framework for drum shells of different materials. For instance, the ultimount framework can be used with more brittle drum shells, such as those made of glass, by lessening the compression force on that shell, but the ultimount framework can also be used with more rigid drum shells, such as those made of wood, by increasing the compression force on that type of shell material.

Once the desired distance between the mounts 210 and 240 is achieved and a desired compression force is imposed on the drum shell using the second threaded nut 870 and the tension rod 230, the top bolt 860 of the tension assembly 820 is then used to lock the position of the second threaded nut 870 relative to the tension rod 230. The exterior thread of the top bolt 860 screws into the interior thread of the tension rod 230, thereby completing the second stage of the male-female coupling mechanism. Specifically, the top bolt 860 passes through the washer 865 and screws into the tension rod 230 until the endcap of the top bolt 860 presses underside of the washer 865 against the top of the second threaded nut 870. In so doing, the top bolt 860 prevents vibrations from altering the position of the second threaded nut 870 on the tension rod 230, thereby maintaining the distance separating the shell mounts 210 and 240 and, as a result, the compression force imposed on the drum shell by the coupling of the shell mounts using the tension rods 230 and the tension assembly 820. The washer 865 can be of varying thickness to enable the top bolt 860 to tighten when there is a gap in space between the second threaded nut 870 and the top bolt 865.

In some embodiments, the ultimount structure and design is adapted to incorporate different elements in addition to or instead of those described above. For example, in some embodiments, the tension rods can comprise shafts with only exterior threads, thereby eliminating the need for the top bolt 860.

As evident from the figures, the ultimount design only subjects the drum shell to a compression force based on the contact between the drum shell and the top 210 and bottom 240 shell mounts. In other words, the drum shell is subject to a y-axial force. However, there are no x-axial forces placed on the drum shell. Any such x-axial forces are placed on the top 210 and bottom 240 shell mounts based on the coupling of the rod holders 230 to the shell mounts. By removing the x-axial forces from the shell, the ultimount structural framework can be mounted on shells constructed from thinner materials than would normally be required for traditional drum mounts. Specifically, the ultimount structural framework supports drum shells made primarily of plastic, clay, or glass. These materials have different resonate properties than traditional wood, steel, or brass shells. Consequently, the ultimount opens the door to a new evolution in drum sound.

Some embodiments provide an enhanced rod holder assembly that further isolates energy transfer from the drumhead to the structural framework. Whereas the assembly of FIG. 8 provides energy absorption and vibration dampening along the horizontal plane at which the assembly couples to the drum shell mount, the enhanced rod holder assembly also incorporates energy absorption and vibration dampening elements along the vertical plane used to secure the tension rod to the assembly anchor. This further ensures that any energy transferred from the drumhead to the ultimount structural framework does not pass to the tension rods to cause any rattling or other distortion to the drum sound.

Figure 15:
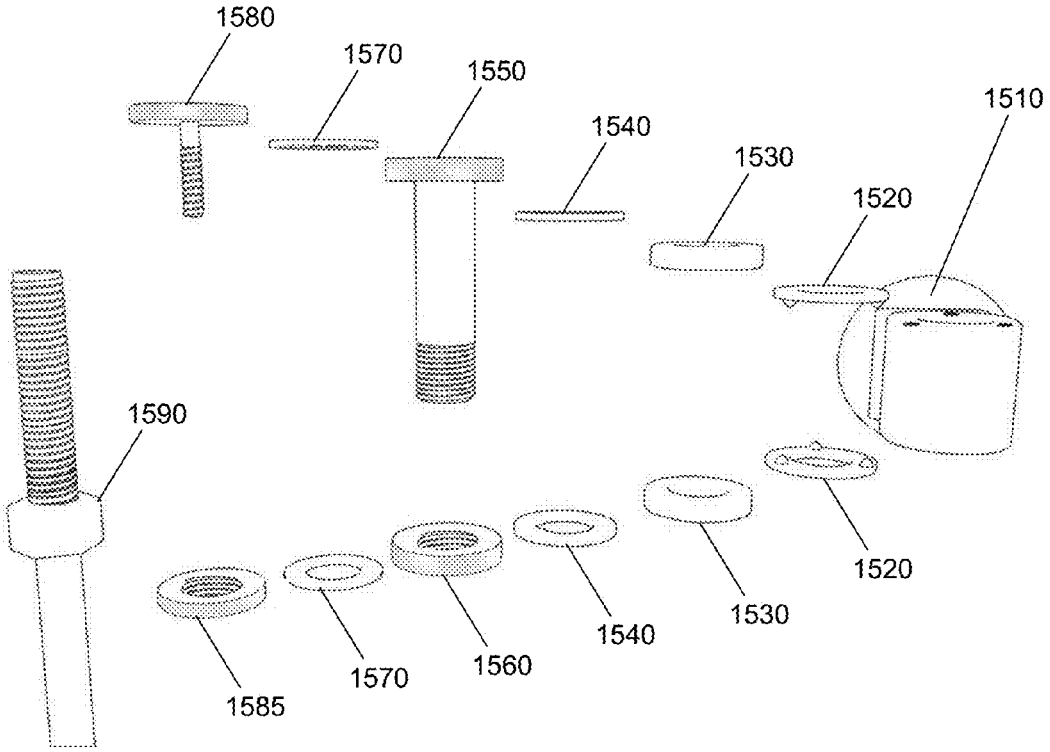
FIG. 15 illustrates an exploded view for the components of the enhanced rod holder assembly in accordance with some embodiments.
Figure 16:
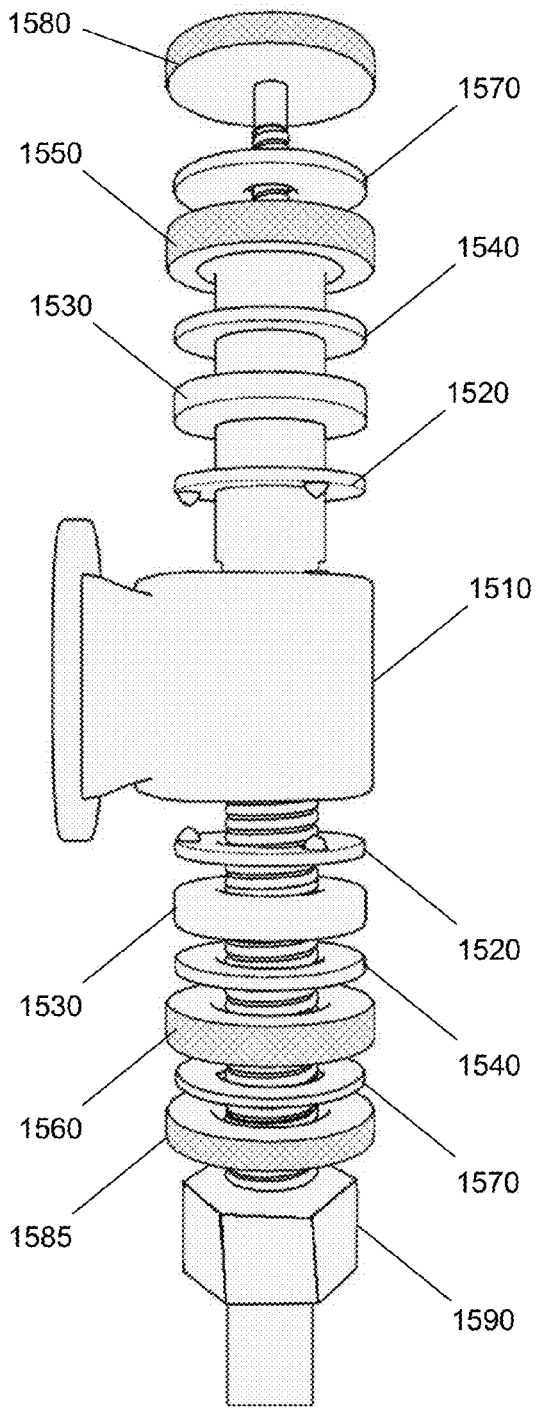
FIG. 16 illustrates assemblage of the enhanced rod holder assembly in accordance with some embodiments.

FIG. 15 illustrates an exploded view for the components of the enhanced rod holder assembly 1500 in accordance with some embodiments. FIG. 16 illustrates assemblage of the enhanced rod holder assembly 1500 in accordance with some embodiments. The enhanced rod holder assembly 1500 depicted in FIGS. 15 and 16 includes an anchor 1510, a pair of endcaps 1520, a pair of vibration absorbing bushings 1530, a first pair of washers 1540, a tension bolt 1550, a first outer nut 1560, a second pair of washers 1570, a lockdown bolt 1580, a second outer nut 1585, and a tension rod 1590. The parts are displayed according to their order of assembly. The parts that are displayed closest to the anchor 1510 are positioned and secured first and the parts that are furthest from the anchor 1510 are positioned and secured last.

Figure 17:
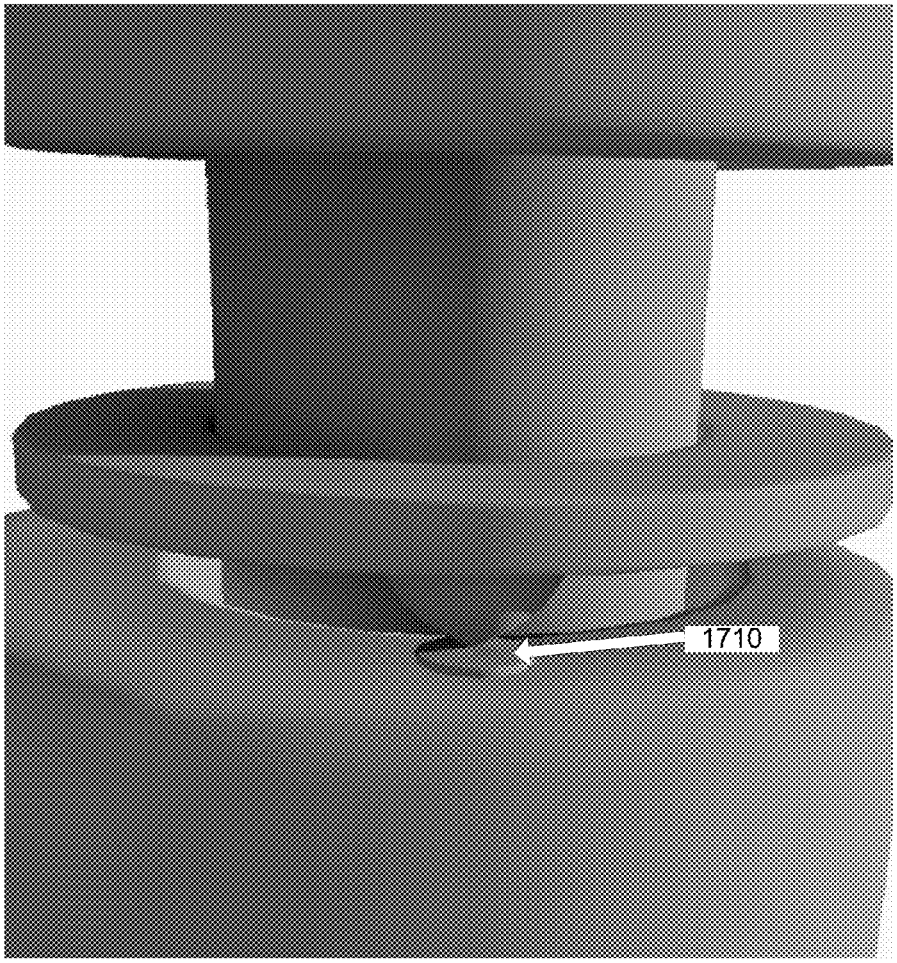
FIG. 17 illustrates the plugs within the anchor vertical recesses.

The anchor 1510 remains mostly unchanged from the three faceted binding anchor 810 of FIG. 8. The anchor 1510 includes a horizontal threaded aperture that secures to one of the drum shell mounts using the same or similar vibration dampening assembly 815 as FIG. 8. The anchor 1510 also includes the bilateral vertical apertures used in coupling and torquing the tension rod to the assembly 1500. In some embodiments, the anchor 1510 is modified to include several recesses along either vertical face. These recesses align with the prongs that protrude from the endcaps 1520. When the endcaps 1520 are placed on either vertical face of the anchor 1510, the surface area contact between the endcaps 1520 and anchor 1510 is minimized to the contact points between the endcap 1520 prongs and the anchor 1510 vertical recesses. By reducing the points of contact between the anchor 1510 and the endcap 1520, the design reduces the amount of energy that can transfer from the anchor 1510 to the vertical assembly components, and ultimately to the tension rod 1590 that couples to assembly 1500. To further reduce energy transfer, some embodiments incorporate plugs within the recesses. The plugs are made of an energy or vibration absorbing material. In some such embodiments, the endcap 1520 prongs press into the plugs with the plugs buffering the contact between the endcap 1520 prongs and the anchor 1510 vertical recesses. In this configuration, the contact between the endcaps 1520 and the anchor 1510 is again minimized to the contact points between the endcap 1520 prongs and the anchor 1510 vertical recesses with the added benefit of having the energy absorbing plugs in between those points of contact. FIG. 17 illustrates a plug 1710 within an anchor vertical recess in accordance with some embodiments.

The first pair of vibration absorbing bushings 1530 placed adjacent to the endcaps 1520 mitigate against further energy transfer, especially any energy that is transferred from the anchor 1510 to the endcaps 1520. These bushings 1530 are made of rubber, plastic, or other energy absorbing material. Accordingly, any energy that transfers from the anchor to the endcaps is dampened or entirely absorbed by the bushings 1530.

The first pair of washers 1540 is placed over the bushings 1530. The washers 1540 serve to distribute the load that is placed on the bushings 1530 by the vertical fastening elements of the assembly 1500.

Figure 18:
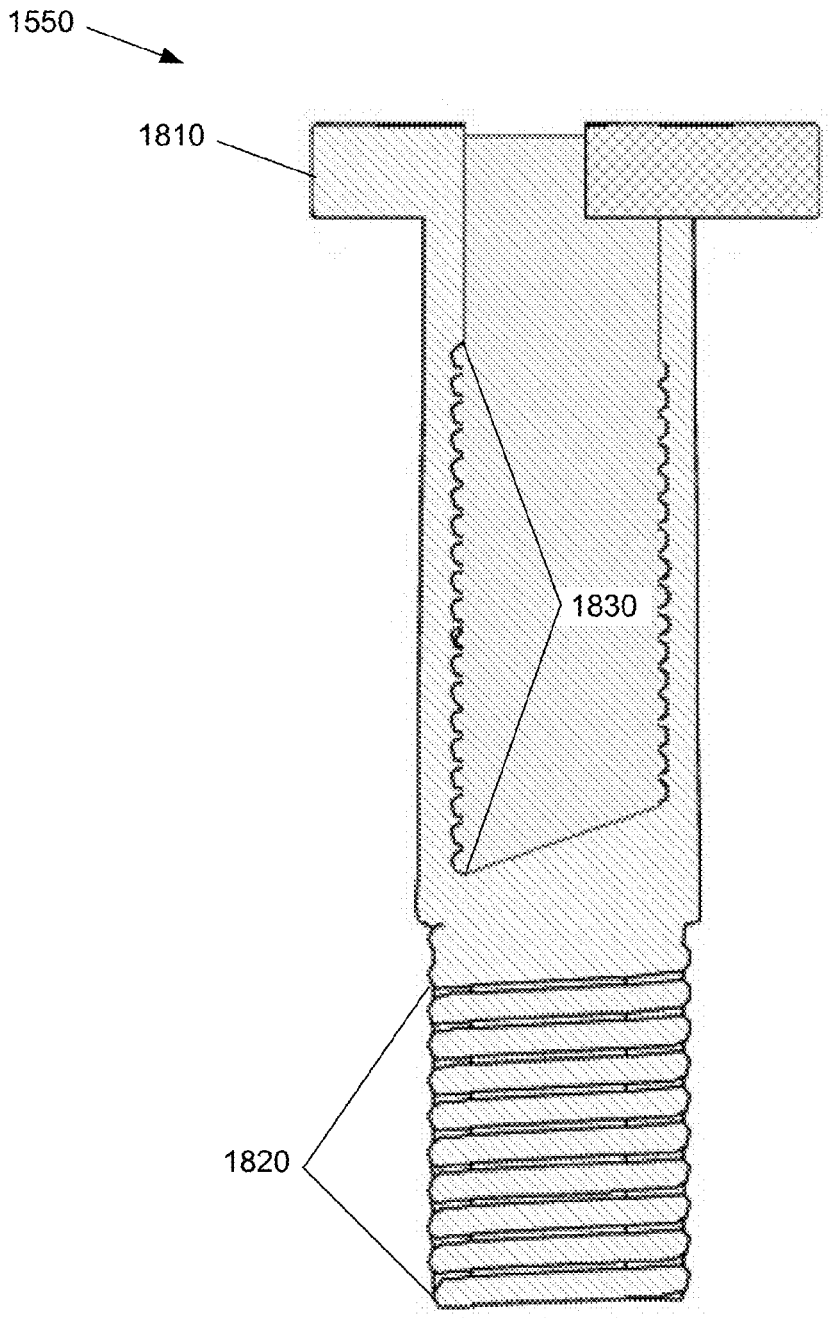
FIG. 18 illustrates a cross-section of the tension bolt.

The vertical fastening elements begin with the tension bolt 1550 and the first outer nut 1560. A cross-section of the tension bolt 1550 is provided in FIG. 18. As seen in FIG. 18, the tension bolt 1550 has an enlarged top 1810, a lower half extension with outer threading 1820, and a vertical cavity or hollowed shaft with inner threading 1830. The vertical cavity spans the full length of the bolt 1550. An aperture centrally located at the enlarged top 1810 provides access to the vertical cavity from the top end of the bolt 1550 and a complimentary aperture at the opposing end of the bolt 1550 provides access to the vertical cavity from the bottom end of the bolt 1550. As will be explained below, the cavity and the threading 1830 are the means with which the tension rod 1590 is coupled to the overall assembly 1500.

The tension bolt 1550 inserts through the top vertical aperture of the anchor 1510 such that a portion of the bolt's 1550 lower half extension passes through the bottom vertical aperture of the anchor 1510. The first outer nut 1560 is then used to secure the bolt 1550 to the anchor 1510. Once attached, the bolt 1550 serves as the coupling receiver for the tension rod 1590, and in combination with the anchor 1510, the bolt 1550 further serves as the torsion block against which the tension rod 1590 is torqued.

In some embodiments, the lower half extension or body of the tension bolt 1550 has a circumference that does not contact the interior of the anchor 1510 when the tension bolt 1550 is inserted into the anchor 1510. This is another design aspect that further mitigates the transfer of energy from the anchor 1500 to the tension bolt 1550, and ultimately to the tension rod 1590 that couples to the tension bolt 1550. In other words, the bolt 1550 never makes direct contact with the anchor 1550. Therefore, the energy that the anchor 1510 absorbs from the drumhead can only pass to the endcaps 1520 and the bushings 1530, each of which provide energy dampening or absorption, before there is any potential for indirect passage into the bolt 1550 and then the tension rod 1590.

Figure 19:
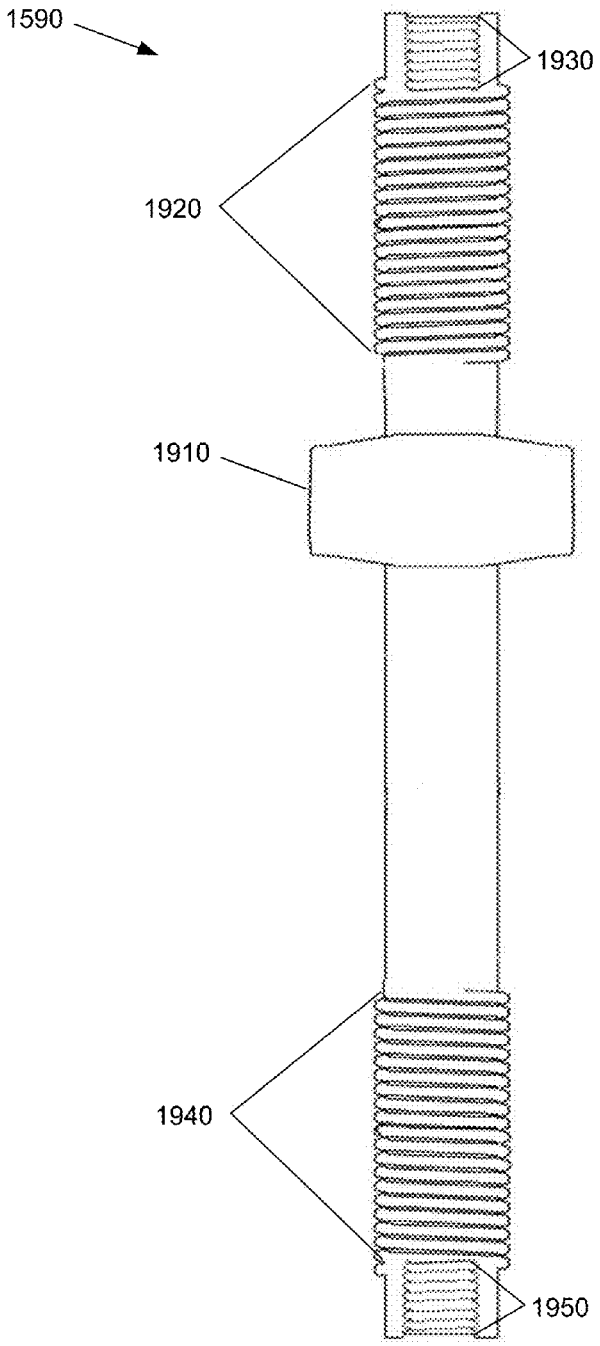
FIG. 19 illustrates the tension rod of some embodiments and further provides a partial cross-sectional view to better illustrate the coupling head at either end of the tension rod.

The tension rod 1590 is a long tubular extension with a specialized coupling head at each end of the rod 1590. FIG. 19 illustrates the tension rod 1590 of some embodiments and further provides a partial cross-sectional view to better illustrate the coupling head at either end of the tension rod 1590. The coupling head at the top end of the tension rod 1590 includes a hexagonal nut 1910, exterior threading 1920, and a hollowed shaft with inner threading 1930. The coupling head at the bottom end includes exterior threading 1940 that is opposing or inverted relative to the top end exterior threading 1920. The coupling head at the bottom end also includes a hollowed shaft with inner threading 1950 that is opposing or inverted relative to the top end inner threading 1930.

The opposing exterior threading 1920 and 1940 provides a vice-like function in conjunction with the tension bolt inner threading 1830. Specifically, when the tension rod 1590 is turned in a first direction, the exterior threading 1920 at the top end screws into the inner threading 1830 of a first tension bolt that is secured to a first anchor coupled to a top shell mount while the exterior threading 1940 at the bottom end simultaneously screws into the inner threading 1830 of a second tension bolt that is secured to a second anchor coupled to a bottom shell mount. This draws the first anchor closer to the second anchor which in turn increases the pressure that is exerted on a drum shell disposed between the top shell mount and the bottom shell mount. Turning the tension rod 1590 in an opposite second direction will unscrew the tension rod 1590 exterior threading 1920 and 1940 from the tension bolts 1550 inner threading 1830, thereby increasing the distance between the top and bottom shell mounts and reducing the pressure on the drum shell.

Figure 20:
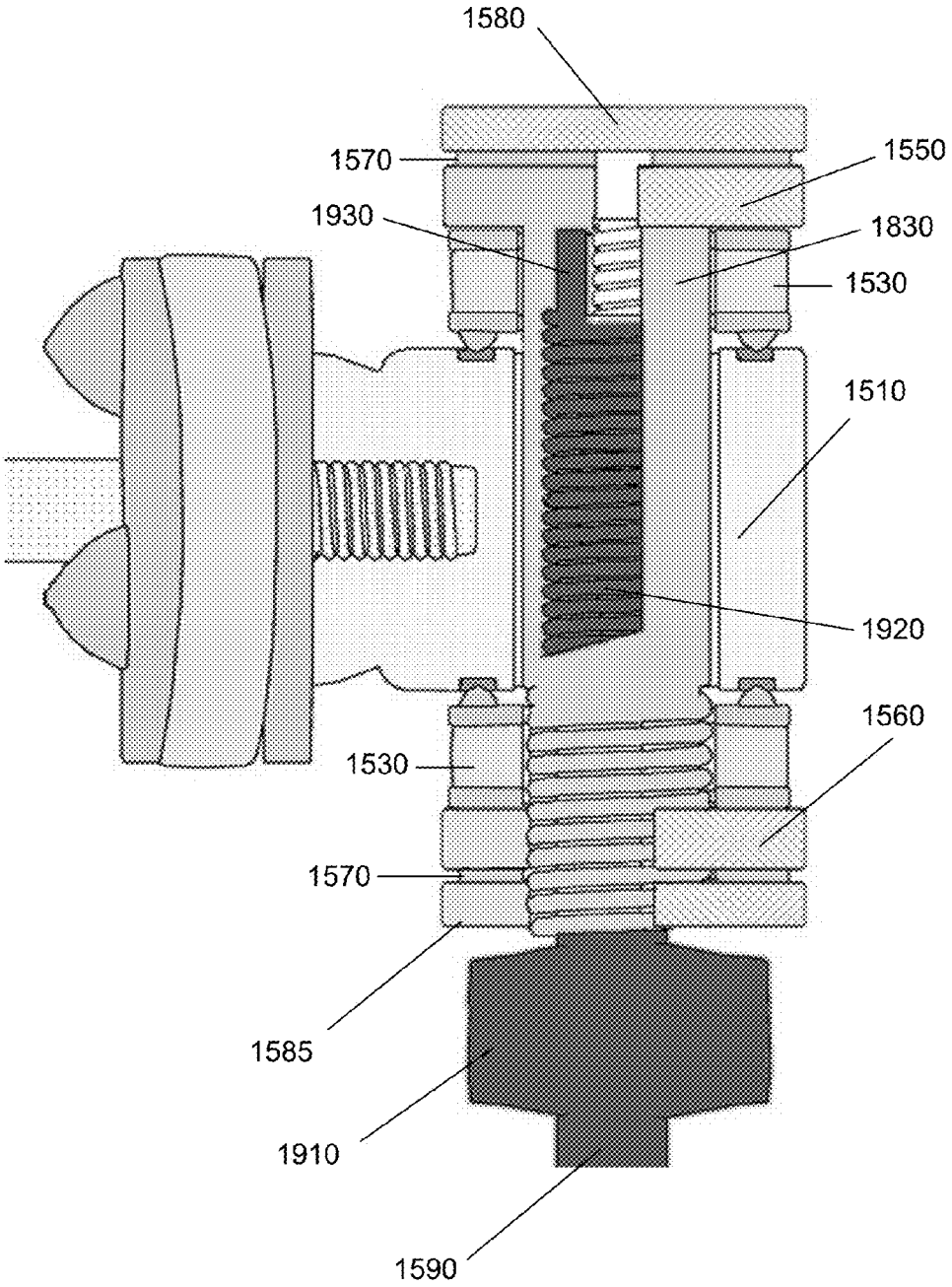
FIG. 20 provides a cutaway illustration for the coupling of one end of the tension rod to a tension bolt.

The coupling of one end of the tension rod 1590 to a tension bolt 1550 is best illustrated by the cutaway illustration of FIG. 20. As shown in FIG. 20, the tension bolt 1550 passes through the anchor 1510 with the first outer nut 1560 attached to the exterior threading of the bolt's 1550 lower half extension. The second pair of washers 1570 is then placed atop the tension bolt 1550 and the downward face of the first outer nut 1560. A second outer nut 1585 secures one of the second pair of washers 1570 against the first outer nut 1560. The tension rod 1590 is then inserted up through the bottom vertical aperture of the tension bolt 1550 until the exterior threaded end 1920 of the tension rod 1590 comes into contact with the inner threading 1830 within the tension bolt 1550 vertical cavity (not shown in FIG. 20). At this point, the hexagonal nut 1910 or body of the tension rod 1590 can be used to screw the tension rod 1590 into the inner threading of the tension bolt 1550, thereby coupling the two structures together. As described above, the tension rod 1590 will be coupled at either end to different tension bolts 1550 that are themselves coupled to different anchors 1510 that in turn are coupled to a top shell mount and a bottom shell mount. Every turn of the tension rod 1590 drives the tension rod 1590 further into the tension bolts 1550 coupled at either end of the tension rod 1590, thereby reducing the distance separating the anchors 1510 that are coupled to the tension bolts 1550 and, as such, reducing the distance separating the top shell mount and the bottom shell mount to which the anchors 1510 are themselves coupled. The hexagonal nut 1910 is provided to aid in torquing the tension rod 1590 into the tension bolts 1550. This allows a user to dial-in a pressure on the drum shell by finely adjusting the distance between the top shell mount and the bottom shell mount of the drum shell.

The position of the tension rod 1590 within the tension bolt 1550 can be fixed using the lockdown bolt 1580. The lockdown bolt 1580 passes through the vertical aperture along the top face of the tension bolt 1550. The lockdown bolt 1580 has an enlarged top and vertical extension with exterior threading that screws into the inner threading 1930 of the tension rod 1590. To secure the position of the tension rod 1590, the lockdown bolt 1580 is screwed into the inner threading 1930 of the tension rod 1590 until the enlarged top of the lockdown bolt 1580 abuts the enlarged top of the tension bolt 1550. In this position, the lockdown bolt 1580 prevents further adjustments to the tension rod 1590. In other words, the tension rod 1590 position within a corresponding tension bolt 1550 is fixed, thereby fixing the distance between two horizontally aligned but vertically separated anchors 1510, and in turn fixing an amount of pressure that is exerted on a drum shell mounted by a top shell mount and a bottom shell mount that are coupled to the vertically separated anchors 1510.

Figure 21:
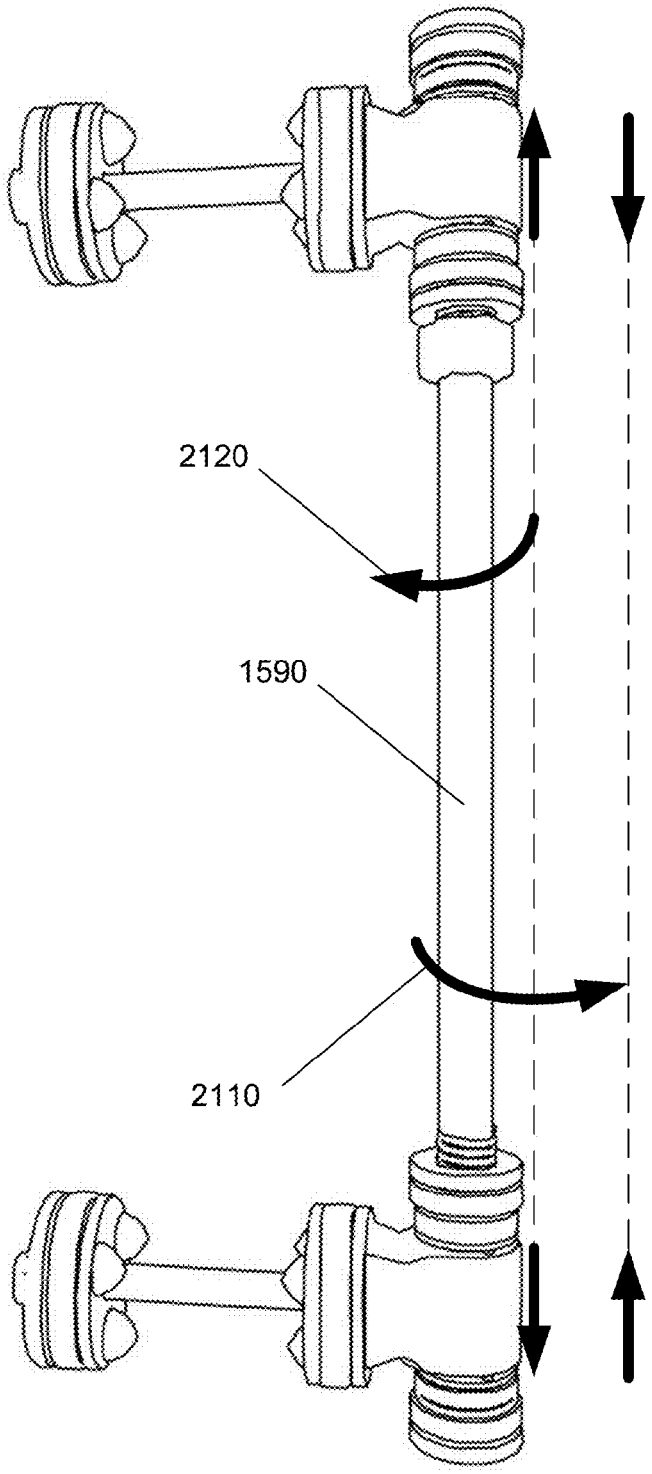
FIG. 21 illustrates a completed assembly in which either end of the tension rod is coupled to different enhanced rod holders.

FIG. 21 illustrates a completed assembly in which either end of the tension rod 1590 is coupled to different enhanced rod holders. The figure further illustrates how turning the tension rod 1590 in a first direction 2110 reduces the distance separating the rod holders and turning the tension rod 1590 in an opposite second direction 2120 increases the distance separating the rod holders.

Some embodiments also provide enhanced drum lug holder assemblies for further isolating and dampening energy transferring from the drumhead to the mounting framework in a manner that does not interfere with the drum shell's resonance. Traditionally, lug holders have been designed to tension the drumhead by securing the drum hoop (containing the drumhead) to the drum shell. In these traditional designs, one end of the lug holder assembly was coupled directly to the drum shell and the other end being coupled to the drum hoop holding the drumhead (i.e., part of the shell mount). However, coupling traditional lug holders directly to the drum shell impedes the resonance of the drum shell and hinders the full potential of the resulting sound. Moreover, coupling traditional lug holders directly to the drum shell increases the horizontal forces exerted on the drum shell. Specifically, once the drumhead has been vertically tensioned by the tension bolt(s), the traditional lug holders exert vice-like horizontal forces on the drum shell as a result of the anchor mounting bolts of the lug holder tensioning the traditional lug holder to the drum shell. These horizontal forces require increased rigidity in the drum shell material such that the drum shell does not deform or crack from the forces imposed by the lug holders. Therefore a drum shell, that is intended to accept traditional lug holder direct-shell coupling, cannot be fabricated with less rigid materials such as plastic, clay, or glass and cannot be given the freedom to resonate to its fullest potential.

A redesigned and enhanced lug holder assembly is provided herein to remove these impediments on the drum shell while retaining the purpose and function of the lug holder. The enhanced lug holder assembly of some embodiments is designed so as to no longer couple directly to the drum shell. Instead, the enhanced lug holder assembly couples the drum hoop that is holding the drumhead to the modified tension ring that is disposed over one end of the drum shell. The ultimount structural framework or other structural framework can then be used to couple a top drum shell mount (comprised of a first drum hoop that is coupled to a first tension ring by one or more of the enhanced lug holder assemblies) to a corresponding bottom shell mount (comprised of a second drum hoop that is coupled to a second tension ring by one or more of the enhanced lug holder assemblies). In this manner, the drumhead is coupled to the drum shell with only the top shell mount and bottom shell mount contacting the drum shell. Some embodiments introduce energy dampening properties to the enhanced lug holder assemblies to further minimize the potential for energy to transfer from the drumhead into whatever structural framework is used to mount the drumhead onto the drum shell.

Figure 22:
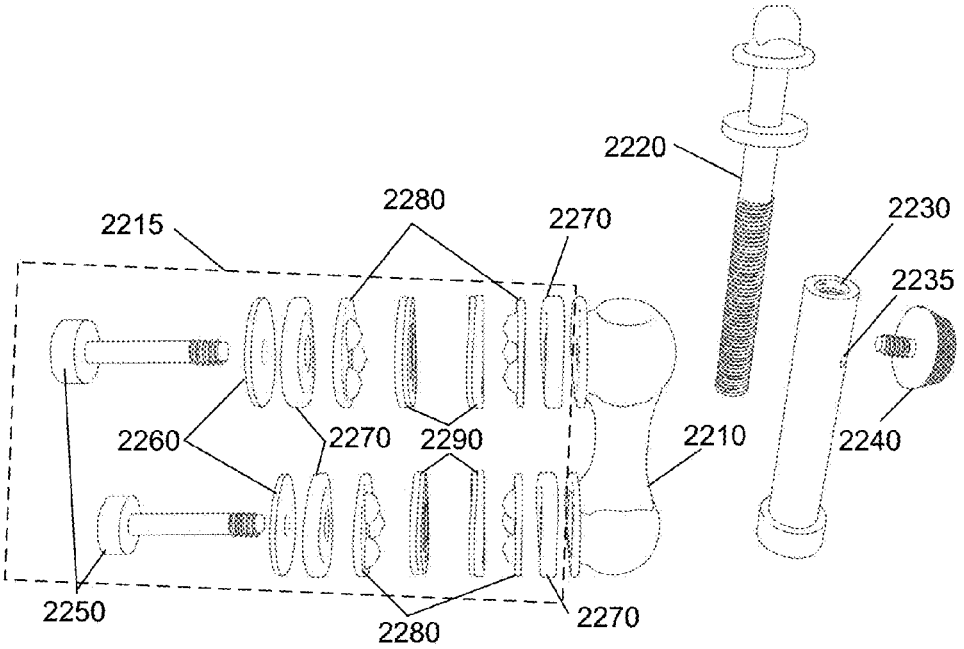
FIG. 22 illustrates an enhanced lug holder assembly of some embodiments.
Figure 23:
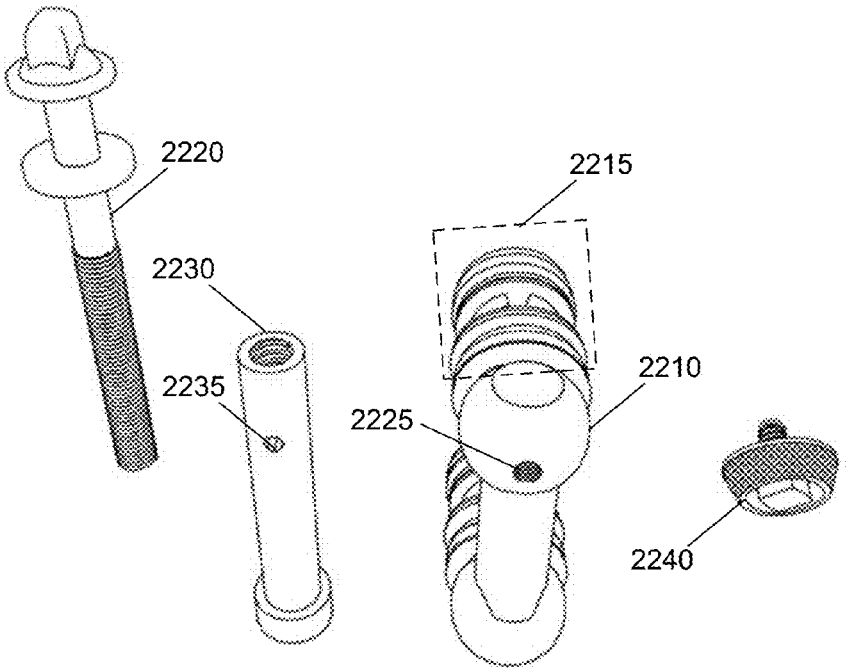
FIG. 23 provides a top view of the enhanced lug holder assembly components.

FIG. 22 illustrates an enhanced lug holder assembly of some embodiments. The enhanced lug holder assembly includes anchor 2210, anchor mounting hardware 2215, vertical tension bolt 2220, swivel nut 2230, and lockdown bolt 2240. FIG. 23 provides a top view of the enhanced lug holder assembly components.

Figure 24:
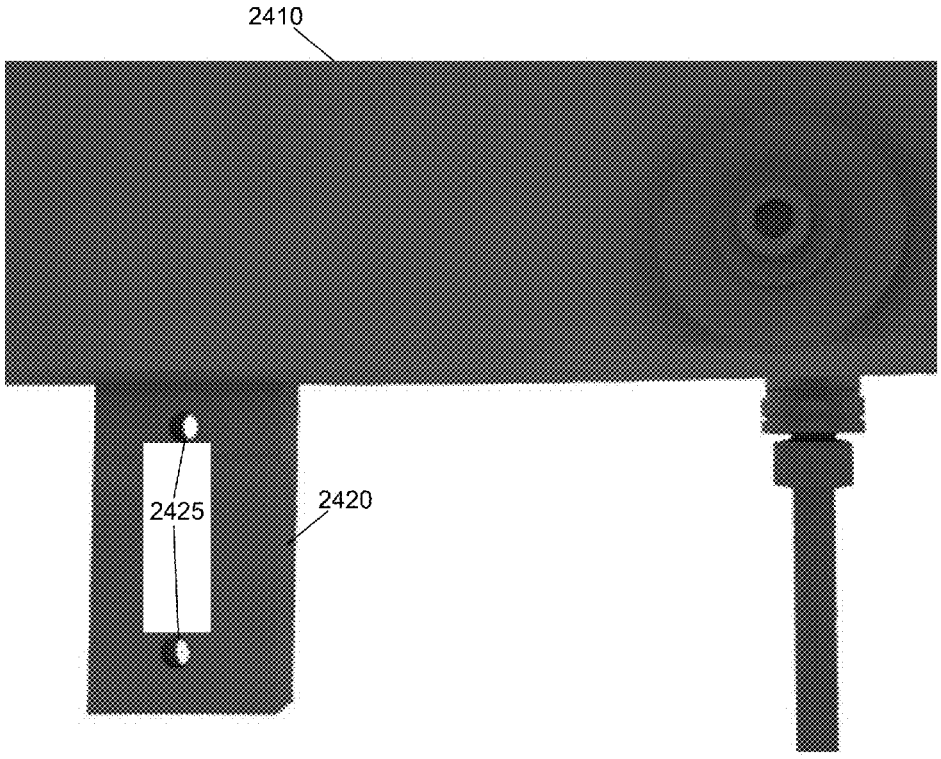
FIG. 24 illustrates the modified tension ring to which the anchor couples.
Figure 25:
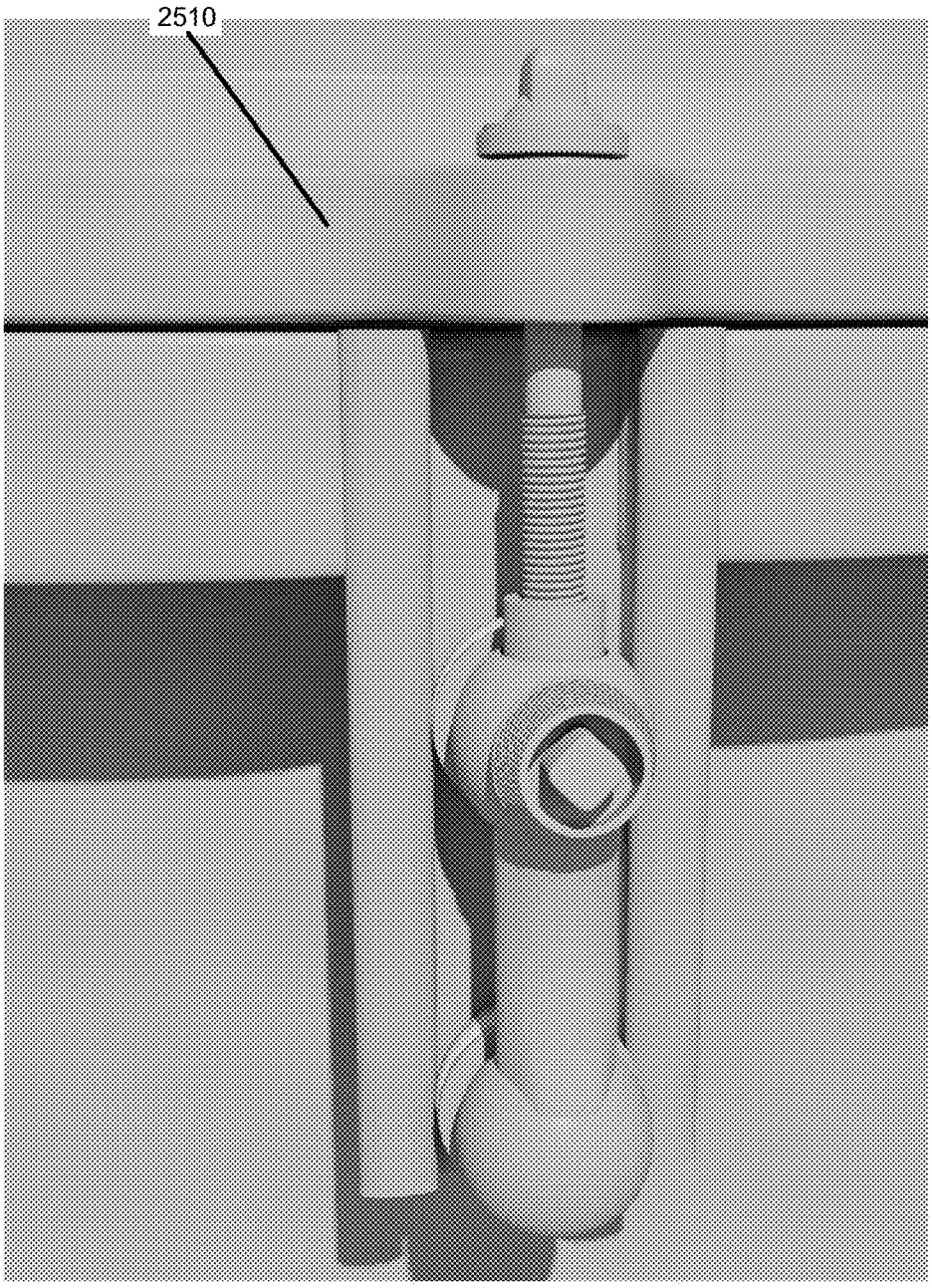
FIG. 25 illustrates a completed enhanced lug holder assembly coupling a die-cast hoop to a modified tension ring.

The anchor mounting hardware 2215 couples the anchor 2210 to a modified tension ring. FIG. 24 illustrates the modified tension ring 2410 to which the anchor 2210 couples. As shown, the modified tension ring 2410 includes one or more vertical brackets 2420 that extend downwards from the tension ring outer face. Each vertical bracket 2420 has one or more apertures 2425. An anchor 2210 is coupled to each such vertical bracket 2420 using the anchor's horizontal mounting hardware 2215. With the anchor 2210 horizontally secured to the modified tension ring 2410, one or more vertical tension bolts 2220 are then used to secure the anchor 2210 to the drum hoop (see reference marker 2510 in FIG. 25) containing the drumhead. It should be evident that the coupling order can be reversed such that the anchor 2210 is first vertically secured to the drum hoop 2510 and then horizontally secured to the modified tension ring 2410. In any event, the enhanced lug holder assembly couples the drum hoop 2510 to the tension ring 2410 to form one of the drum shell mounts. FIG. 25 illustrates a completed enhanced lug holder assembly coupling a drum hoop to the modified tension ring of FIG. 24.

With reference back to FIG. 22, the anchor 2210 is formed with two spheres that are connected with a cylindrical body. This form is illustrative of one embodiment of the anchor 2210. Specifically, this form is for coupling the anchor 2210 to a tension ring having vertical mounting brackets with two apertures that align with the position of the anchor 2210 spheres. If the tension ring mounting brackets were of a different orientation, the anchor 2210 can be reformed to match the tension ring mounting bracket orientation. Accordingly, other alternative forms are possible without affecting the function and utility of the enhanced lug holder assembly.

Figure 26:
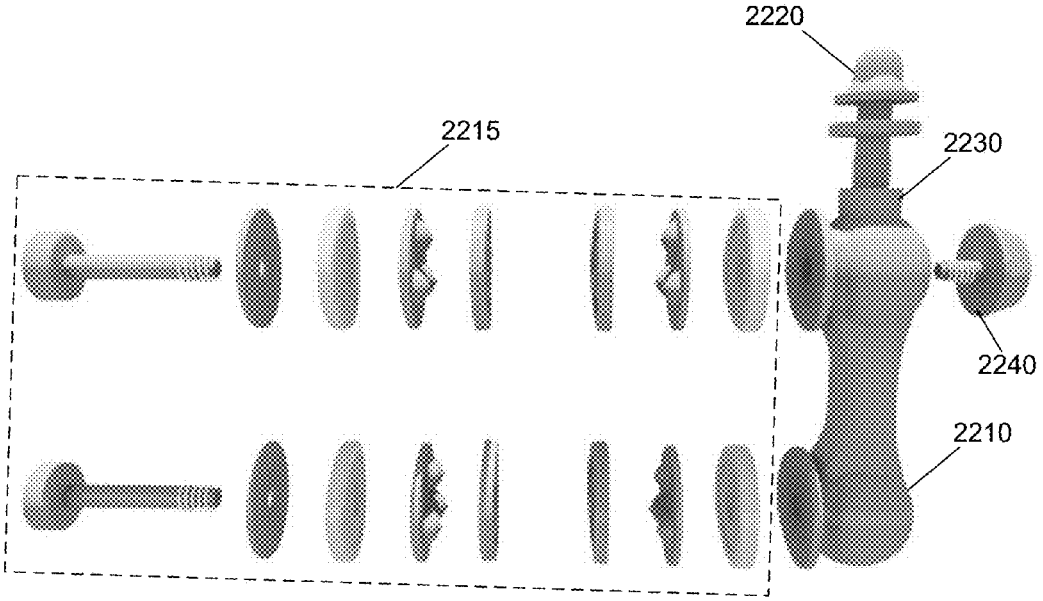
FIG. 26 illustrates the tension bolt couples to the interior threads of the sleeve disposed within the anchor.
Figure 27:
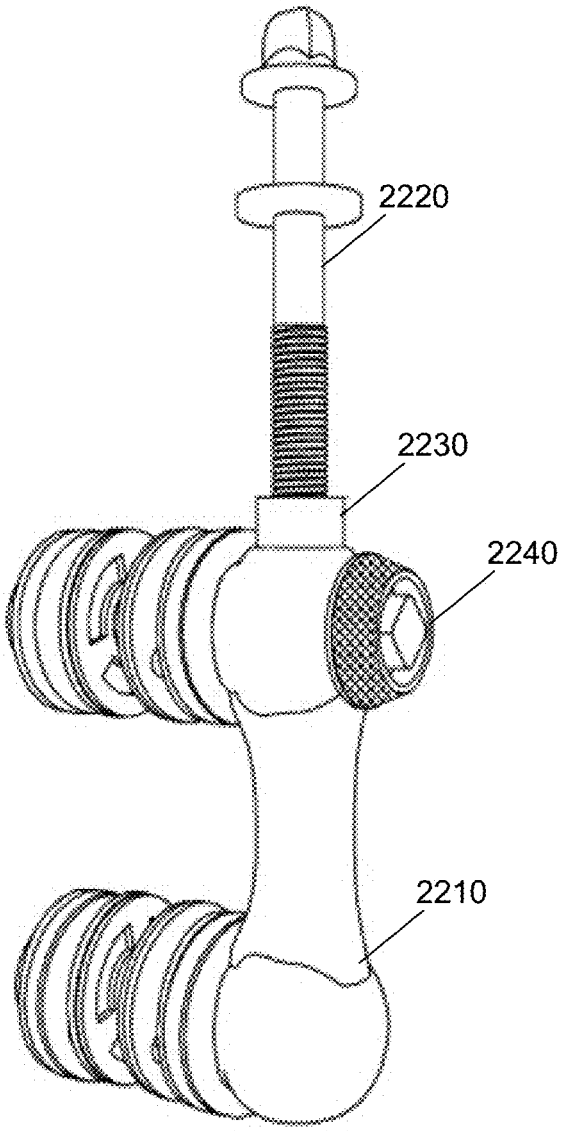
FIG. 27 illustrates the lockdown bolt screwing into the rear of the anchor, thereby imposing a horizontal force on the tension bolt that prevents further vertical movement of the tension bolt.

The anchor 2210 includes a vertical cavity that runs the length of the anchor 2210. The swivel nut 2230 is inset and affixed within the vertical cavity. In some embodiments, the swivel nut 2230 has an elongated bottom that retains the swivel nut 2230 within the bottom sphere of the anchor 2210. The swivel nut 2230 further contains inner threading into which the exterior threads of the vertical tension bolt 2220 screw into as shown by FIG. 26. The vertical tension bolt 2220 screws into the swivel nut 2230 in order to secure the drum hoop 2510 to the modified tension ring 2410. Specifically, the vertical tension bolt 2220 first passes through an extruded opening extending along the outer vertical face of the drum hoop 2510 as shown in FIG. 25. Then the outer threading of the vertical tension bolt 2220 screws into the inner threading of the swivel nut 2230. The lockdown bolt 2240 secures the position of the vertical tension bolt 2220 within the anchor 2210. More specifically, the outer threaded lockdown bolt 2240 screws into an inner threaded aperture at the rear of the anchor 2210 top sphere (see reference marker 2225 in FIG. 23). As shown in FIGS. 22 and 23, the swivel nut 2230 contains a non-threaded aperture 2235 that allows the outer threading of the lockdown bolt 2240 to pass though so that the tip of the lockdown bolt 2240 can make contact with the outer threading of the vertical tension bolt 2220. To facilitate this, the non-threaded aperture of the swivel nut 2235 is aligned with the inner threaded aperture 2225 located at the rear of the anchor 2210 top sphere. As shown by FIG. 27, the lockdown bolt 2240 outer threading screws clockwise into the inner threading aperture 2225 in the rear of the anchor 2210, thereby imposing a horizontal force on the outer threading of the vertical tension bolt 2220 that prevents further rotational movement of the vertical tension bolt 2220. The lockdown bolt 2240 may include Teflon in the tip or other material so as to prevent damage to the outer threading of the vertical tension bolt 2220 upon contact. In some embodiments, the drum hoop 2510 contains a threaded aperture in the protrusion through which the vertical tension bolt 2220 passes. A lockdown bolt may be used in addition to or instead of the lockdown bolt 2240 of the anchor 2210 in order to secure a vertical position of the vertical tension bolt 2220.

The front face of each sphere of the anchor 2210 includes a horizontal cavity with inner threading. As noted above with reference to FIG. 24, these horizontal cavities align with apertures 2425 along the vertical bracket 2420 that extends from the modified drum tension ring 2410. The anchor mounting hardware 2215 is then used to secure the anchor 2210 to the vertical bracket 2420.

Figure 28A:
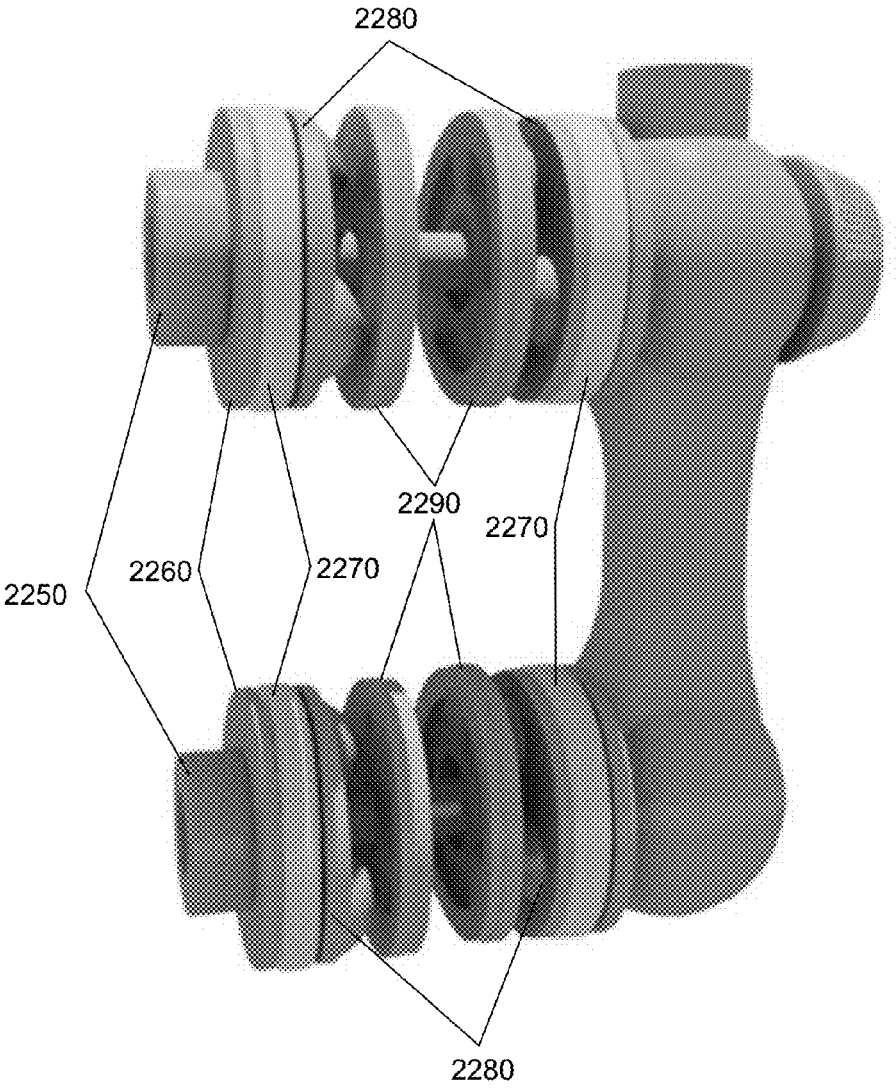
FIG. 28A illustrates a completed configuration of the mounting hardware with respect to the anchor.

FIG. 28A illustrates a completed configuration of the mounting hardware 2215 with respect to the anchor 2210. The mounting hardware 2215 includes horizontal tension bolts 2250, spacers 2260, dampeners 2270, gripped endcaps 2280, and coupling spacers 2290. The spacers 2260, dampeners 2270, gripped endcaps 2280, and coupling spacers 2290 are positioned on either side of the tension ring vertical bracket. Specifically, a coupling spacer 2290 is placed at either side of a vertical bracket aperture. Extrusions on one side of the coupling spacer 2290 face the vertical bracket. The small round recesses on the opposite side of the coupling spacer 2290 provide a guide for the prongs on the gripped endcap 2280 that abut the coupling spacers 2290. The prongs on the gripped endcaps 2280 reduce the potential for energy to transfer from the drumhead to the tension ring and ultimately the structural framework that compresses the drum shell. The dampeners 2270 abut the gripped endcaps 2280, along the side that has no prongs. The dampeners 2270 further aid in reducing energy from transferring to the structural framework. Spacers 2260 are then positioned on either side of the dampeners 2270 as shown in FIG. 22. To couple the anchor 2210 to the tension ring vertical bracket 2420, a horizontal tension bolt 2250 is passed through the positioned mounting hardware 2215 and through the aperture 2425 in the vertical bracket 2420, as shown in FIG. 24, with the horizontal tension bolt 2250 screwing into one of the horizontal inner threaded horizontal cavities in the front face of each sphere of the anchor 2210.

Figure 28B:
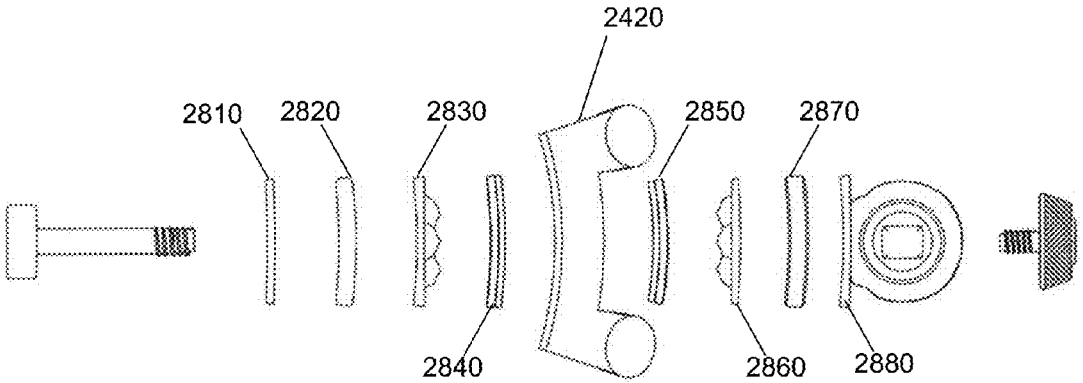
FIG. 28B illustrates the convex and concave shaped parts of some embodiments.

It should be noted that in some embodiments the mounting hardware 2215 is contoured to rest flush against the radius of the modified tension ring vertical bracket 2420. The shape of parts 2260, 2270, 2280, and 2290 can be seen from the top view provided by FIG. 28B. In FIG. 28B, the spacer 2810, dampener 2820, gripped endcap 2830, and coupling spacer 2840, positioned against the inside radius of the modified tension ring vertical bracket 2420, have a convex shape. In contrast, the coupling spacer 2850, gripped endcap 2860, dampener 2870, and mounting coupler plate 2880, positioned against the outside radius of the modified tension ring vertical bracket 2420, have a concave shape. Due to these specific contours for each set of vibration dampening components in some embodiments, neither set of components is interchangeable with respect to their assemblage onto the vertical bracket 2420.

Figure 29:
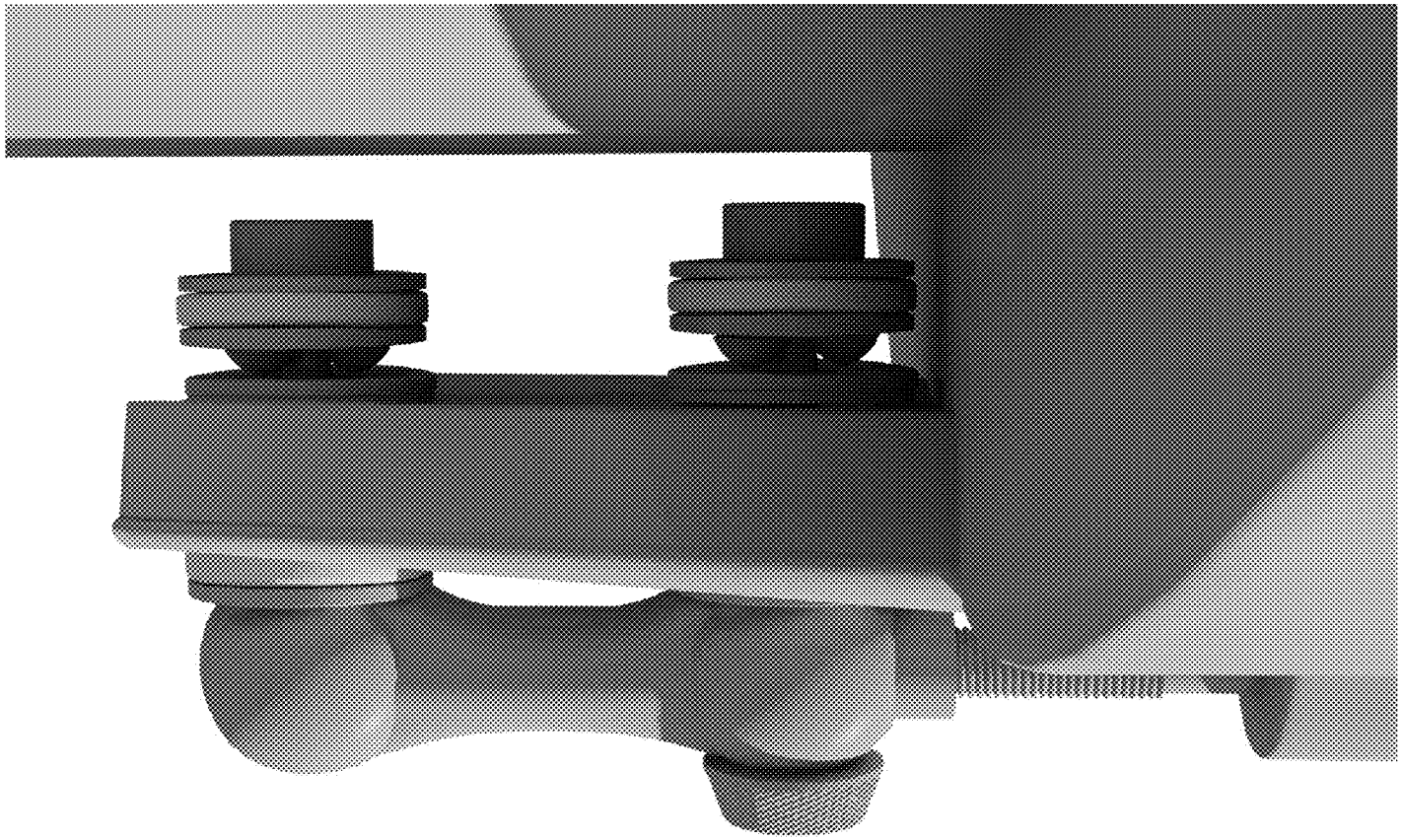
FIG. 29 illustrates a side view of the enhanced lug holder assembly coupled to the tension ring vertical bracket.

FIG. 29 illustrates a side view of the enhanced lug holder assembly coupled to the modified tension ring vertical bracket. As can be seen, the vertical bracket provides sufficient separation to allow the drum shell to freely resonate. Stated differently, besides the top shell mount and the bottom shell mount, there is nothing contacting the drum shell. The enhanced lug holder assembly couples the drumhead to the modified tension ring to form a shell mount and a structural framework (such as the ultimount framework described above) is used to retain the drum shell between a top shell mount and a bottom shell mount with a user specified amount of pressure on the drum shell.

Thus far, the enhanced lug holder assembly has been described to function in conjunction with the ultimount structural framework or other structural framework, wherein the structural framework controls the amount of compression the top and bottom shell mounts impose on the drum shell. In some embodiments, the enhanced lug holder assembly is adapted to function without such a separate structural framework. Specifically, some embodiments provide an adapted lug holder assembly that can function similar to existing lug holders of the prior art that couple the drum hoops or shell mounts containing the drum hoops directly to the drum shell. In some such embodiments, the adapted lug holder assembly is directly coupled to the drum shell at one end and directly coupled to a drum hoop or shell mount containing the drum hoop at the opposite end. In doing so, the adapted lug holder assembly itself can be used to adjust the compression on the drum shell, thereby eliminating the need for the enhanced tension ring with the vertical brackets described above with reference to FIGS. 24 and 25 as well as the need for a separate structural framework that compresses the drum shell by controlling the force imposed on the drum shell by the top and bottom shell mounts. The adapted lug holder assembly of some embodiments improves upon existing lug holder assemblies of the prior art by carrying over the energy isolation and dampening structural elements that minimize unwanted energy transferring from the drumhead into the lug holder assemblies, where the energy can distort the drum sound by causing the lug holders to rattle or otherwise create extraneous sound during drum play.

Figure 30:
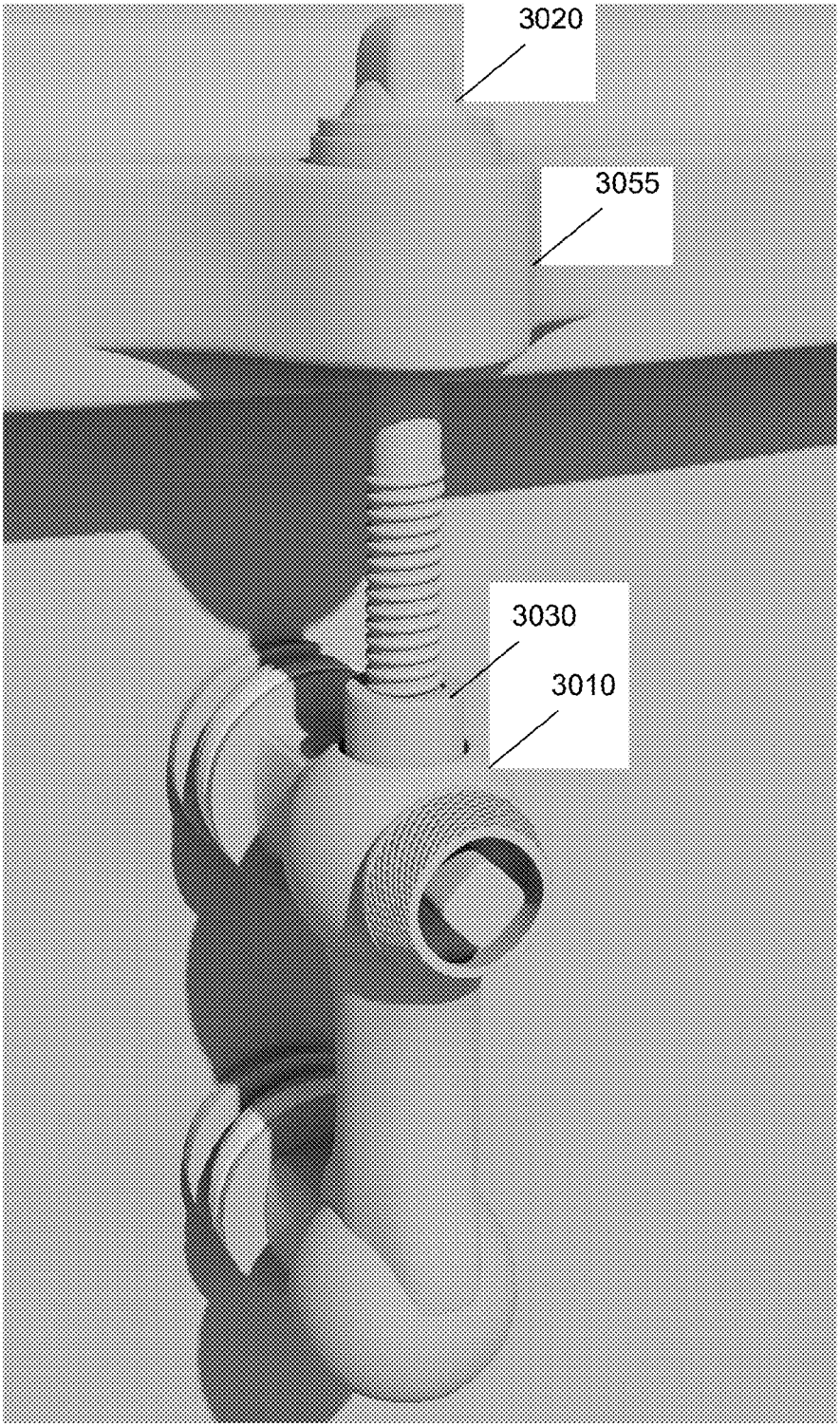
FIG. 30 provides a perspective view for the adapted lug holder assembly of some embodiments that directly couples to the drum shell.
Figure 31:
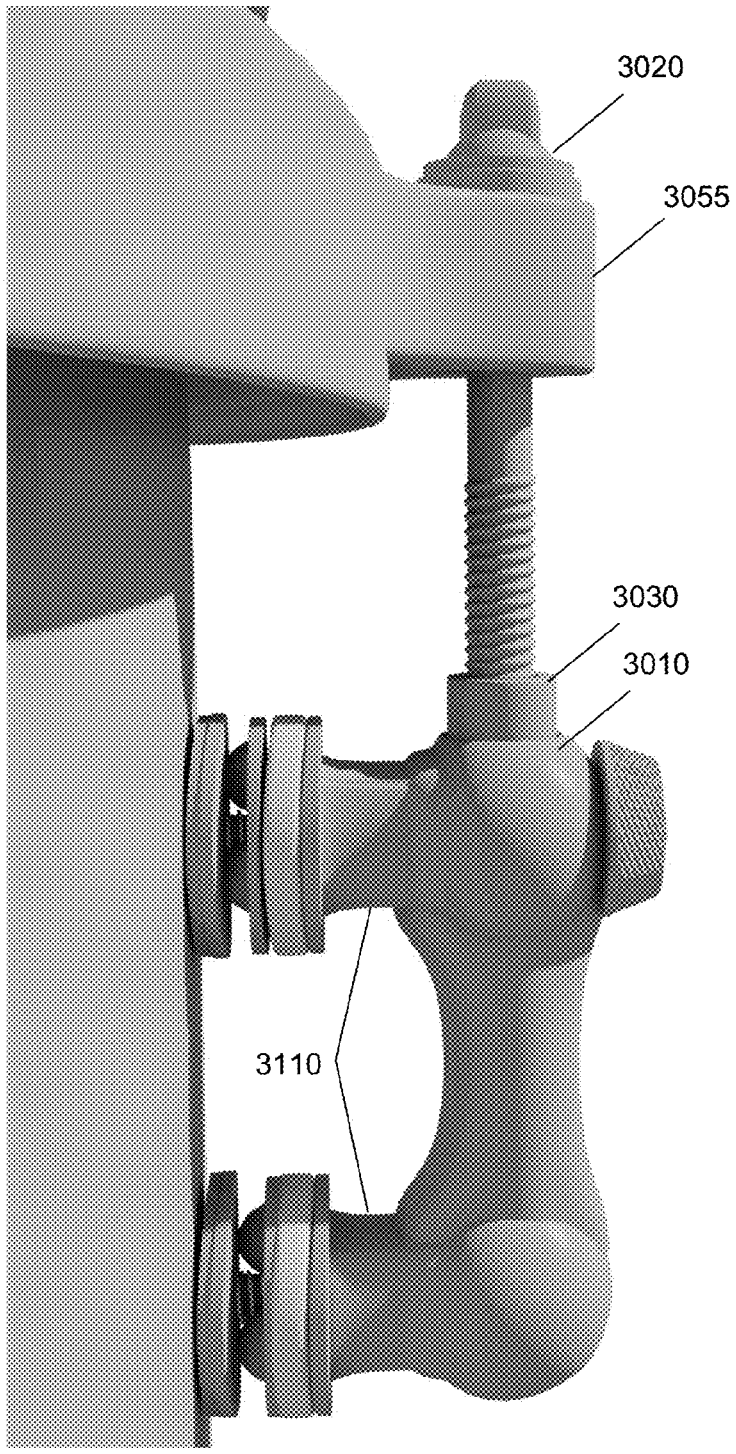
FIG. 31 provides an alternative side view for the adapted lug holder assembly.

FIG. 30 provides a perspective view for the adapted lug holder assembly of some embodiments that directly couples to the drum shell. FIG. 31 provides an alternative side view for the adapted lug holder assembly.

As can be seen from both figures, the adapted lug holder assembly directly couples to the drum hoop or shell mount by passing a vertical tension bolt 3020 through a circular extrusion 3055 along the outer vertical face of the drum hoop or the shell mount and by screwing the vertical tension bolt 3020 outer threading into the inner threading of the swivel nut 3030 that is inset within the assembly anchor 3010. In some embodiments, the circular extrusion contains a threaded aperture. A lockdown bolt may be screwed into the threaded aperture such that the tip of the lockdown bolt can make contact with the outer threading of the vertical tension bolt 3020, thereby preventing further rotation of the vertical tension 3020.

The adapted lug holder assembly also horizontally couples to the drum shell by passing secondary bolts (not shown) from inside the drum shell through apertures along the surface of the drum shell and by screwing the secondary bolts into horizontal threaded cavities about the assembly anchor 3010 horizontal face. Various energy absorption and sound isolation elements are positioned on either side of the drum shell to reduce unwanted rattling and other sound distortions from the adapted lug holders. The vertical tension bolt 3020 is used to adjust the amount of y-axis compression the drum hoop (containing the drumhead) exerts on the drum shell.

Figure 32:
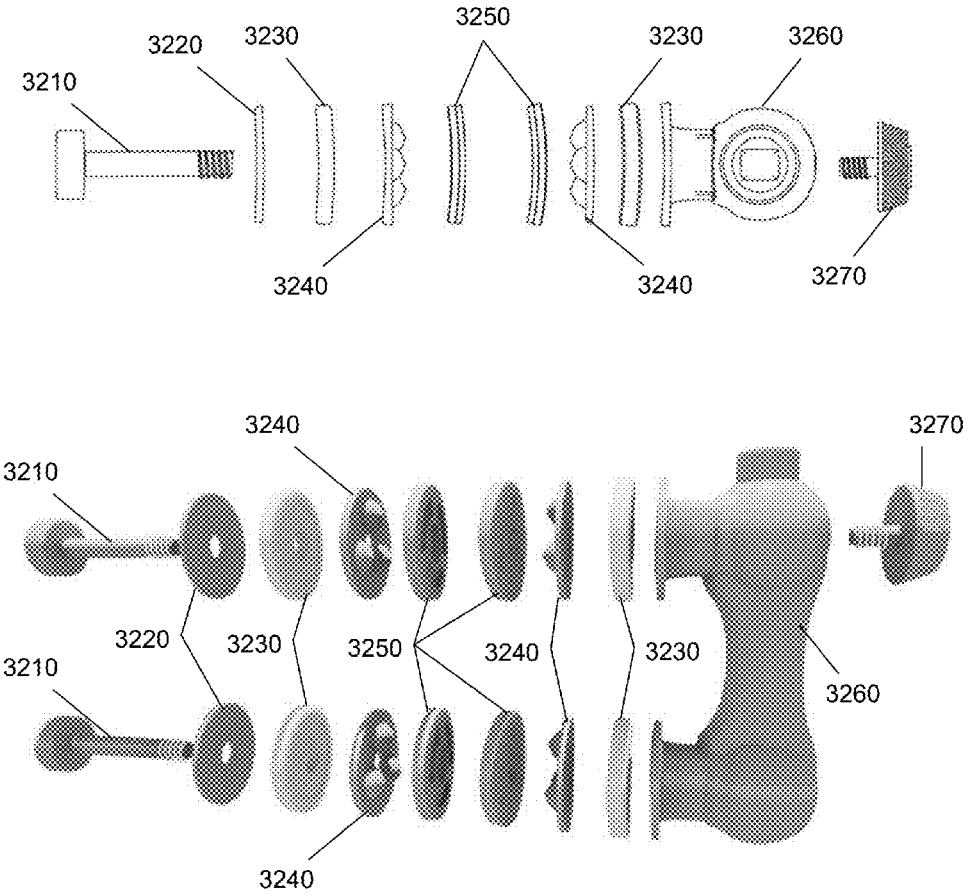
FIG. 32 illustrates the structural elements for the adapted lug holder assembly that directly couples to the drum shell.

As shown in FIG. 32, the structural elements for the adapted lug holder assembly that directly couples to the drum shell are very much similar to the structural elements for the enhanced lug holder assembly of FIGS. 22-29 that couples to the modified tension ring vertical brackets. As before, the elements include horizontal anchoring bolts 3210, washers/spacers 3220, dampeners 3230, gripped endcaps 3240, coupling spacers 3250, anchor 3260, lockdown bolt 3270, and vertical tension bolt (not shown). The anchor 3260 includes an inset swivel nut with inner threading for receiving the outer threading of the vertical tension bolt (not shown). In some embodiments, elements 3220, 3230, 3240, and 3250 may be shaped to rest flush against the inside and outside radius of the drum shell surface, with elements positioned on the inside of the drum shell having a convex shape and those elements positioned on the outside of the drum shell having a concave shape.

In contrast to the structural similarities that the above elements possess, the adapted lug holder anchor 3260 and the horizontal anchoring bolts 3210 have been modified to sufficiently couple the adapted lug holder assembly directly to the drum shell. In some embodiments, the inner threaded mounting coupler plate (reference marker 2880 of FIG. 28B) attached to each sphere of the adapted lug holder anchor 3260 is extended horizontally from the front face of each sphere of the adapted lug holder anchor 3260. Also, the horizontal anchoring bolts 3210 are elongated so that they have sufficient length to extend from the interior of the drum shell outwards to the inner threaded mounting coupler plate that is horizontally extended from the front face of each sphere of the adapted lug holder anchor 3260. FIG. 31 also illustrates horizontal extenders 3110 that occupy the same space as the vertical brackets 2420 found on the modified tension ring 2410 and used with the enhanced lug holder anchor 2210 of FIGS. 22-29. These horizontal extenders 3110 are elongated so that they have sufficient length to extend the spheres of the adapted lug holder outwards, away from the radial exterior surface of the drum shell. This aligns the outer threading of vertical tension bolt 3020 with the inner threading of the swivel nut 3030 that is inset in the anchor so that the vertical tension bolt 3020 can screw into the swivel nut 3030 in order to secure the drum hoop (containing a drumhead) to the drum shell.

With reference back to FIG. 32, directly coupling the adapted lug holder assembly to the drum shell involves positioning the extrusions of the coupling spacers 3250 to face on either side of an opening along the drum shell surface, wherein the drum shell opening is aligned with a horizontal cavity of the anchor 3260. The small round recesses on the opposite side of the coupling spacer 3250 provide a guide for the prongs on the gripped endcaps 3240 that abut the coupling spacers 3250. The prongs on the gripped endcaps 3240 reduce the potential for energy to transfer from the adapted lug holder anchor 3260 to the horizontal mounting hardware which abut the gripped endcaps 3240 and compress the drum shell on the x-axis. The dampeners 3230 are positioned to abut the gripped endcaps 3240, along the side that has no prongs, and the washers/spacers 3220 are positioned to abut the dampeners 3230. The shaft of the horizontal anchoring bolt 3210 is then passed from inside the drum shell through the positioned mounting hardware with the outer thread of the horizontal anchor bolt 3210 outer threading screwing into the horizontal inner threaded cavity on the front face of each sphere of the anchor 3260. This secures the anchor 3260 to the exterior surface of the drum shell. This process of securing the adapted lug holders across the side of the drum shell is repeated for as many enhanced lug holder assemblies as will be needed to couple the drum hoops or shell mounts to the drum shell. Tension bolts (i.e., 3020) are used to secure each anchor 3260 to the drum hoop containing the drumhead. Here again, the tension bolt 3020 passes through an aperture along the circumferential face of the drum hoop 3055. Then the outer threading of the vertical tension bolt 3020 screws into the inner threading of the swivel nut 3030 which is inset in the vertical cavity of the anchor 3260. The y-axis compression force on the drum shell can be controlled by tightening or loosening the vertical tension bolts 3020. As before, the swivel nut 3030 contains a non-threaded aperture along one side of its shaft. This aperture allows the outer threading of the lockdown bolt 3270 to pass through, so that the tip of the lockdown bolt 3270 can make contact with the outer threading of the vertical tension bolt 3020. To facilitate this, the non-threaded aperture of the swivel nut 3030 is aligned with the inner threaded aperture located at the rear of the anchor 3260 top sphere. As shown by FIG. 32, the outer threading of the lockdown bolt 3270 screws clockwise into the inner threading aperture in the rear of the top sphere of the anchor 3260, thereby imposing a horizontal force on the outer threading of the vertical tension bolt 3020 that prevents further rotational movement of the vertical tension bolt 3020. The lockdown bolt 3270 may include Teflon in the tip or other material so as to prevent damage to the outer threading of the tension bolt 3020 upon contact. Similar assembly is performed on the opposite end of the drum shell with a second set of adapted lug holder assemblies to couple the opposing drum hoop shell mount directly to the drum shell, if desired.

It should be evident that a drum designed to utilize two drumheads requires two individual sets of adapted lug holder assemblies to provide a playable drum. A first set of adapted lug holder assemblies couple the top drum hoop or top shell mount holding the drumhead to the drum shell and a second set of adapted lug holder assemblies to couple the bottom drum hoop or drum shell mount to the drum shell, thereby compressing the drum shell on both ends. To simplify the installation and eliminate the need for two sets of lug holder assemblies, some embodiments provide an adapted lug holder assembly with a single modified anchor that has upward and downward oriented swivel nuts in which each have inner threading. This modified anchor permits coupling a drum hoop (containing a drumhead) to the top and the bottom of the drum shell and allows individual tuning of the top and bottom drumheads by adjusting the amount of y-axis compression on each drum hoop.

Figure 33:
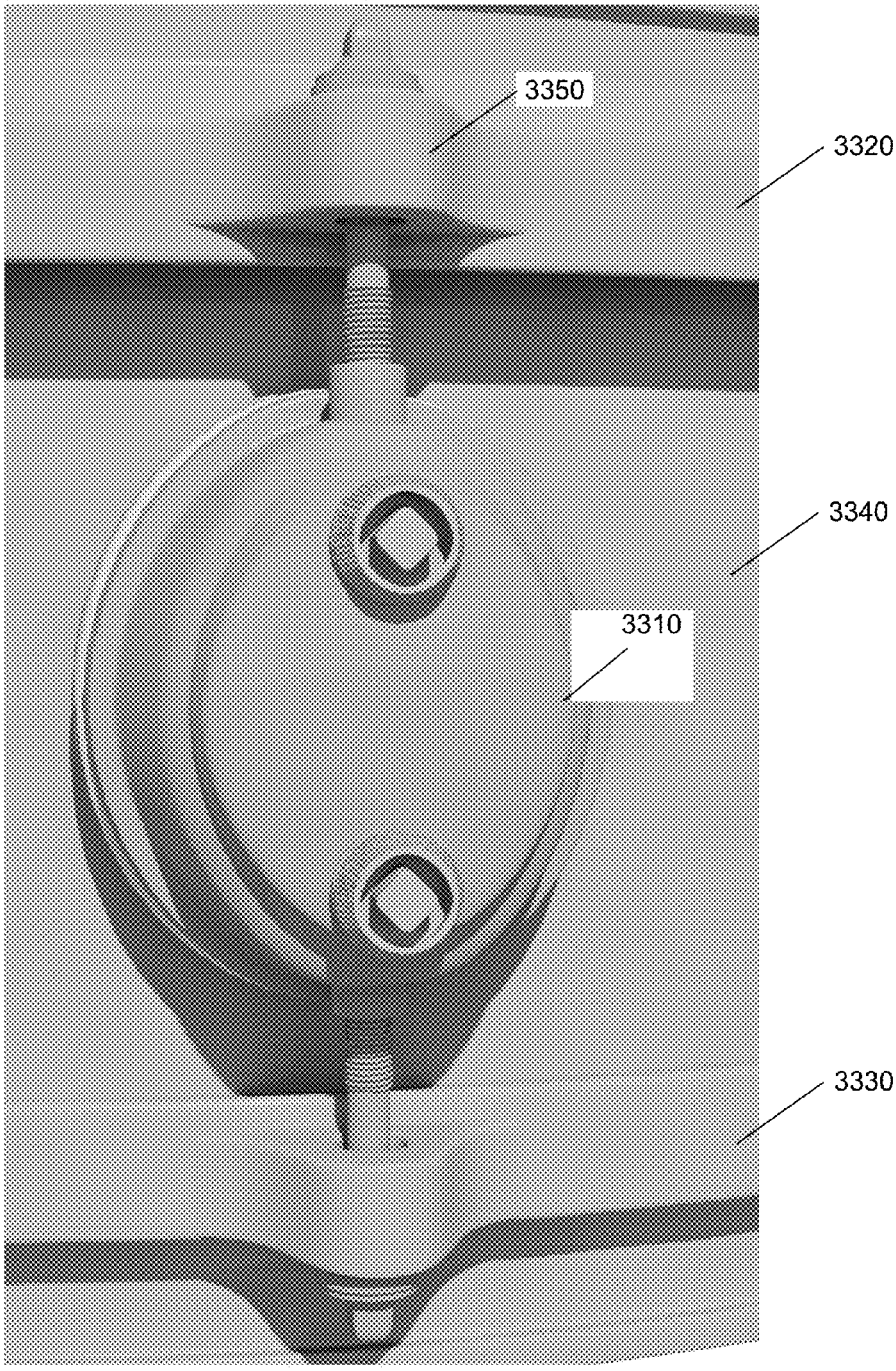
FIG. 33 illustrates the adapted lug holder assembly with the modified anchor of some embodiments.
Figure 34:
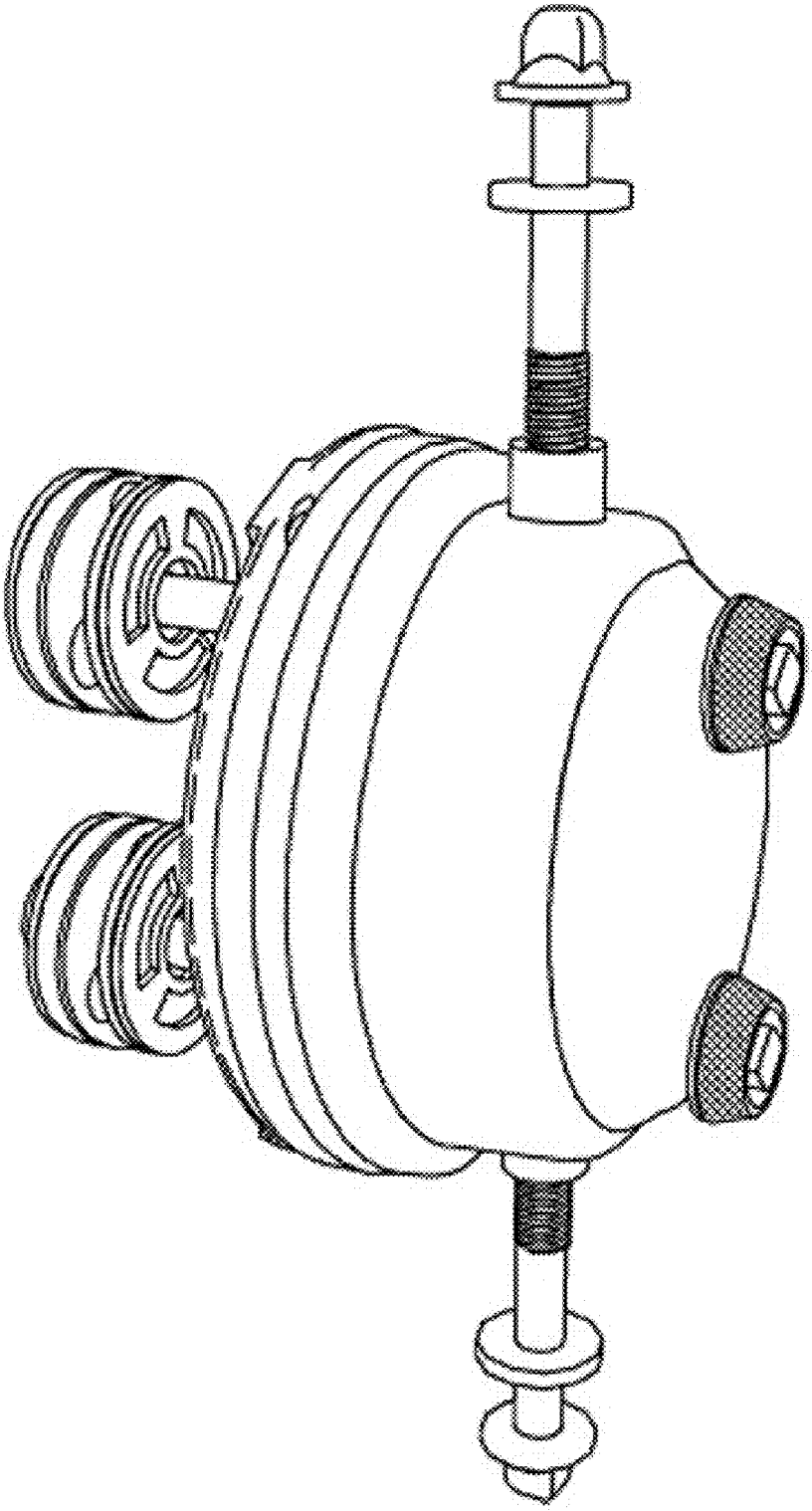
FIG. 34 illustrates the adapted lug holder with the modified anchor assembled with complete horizontal mounting hardware and vertical mounting hardware in accordance with some embodiments.

FIG. 33 illustrates the adapted lug holder assembly with the modified anchor 3310 of some embodiments. Like the adapted lug holder assembly of FIG. 32, the adapted lug holder assembly with the modified anchor of FIG. 33 relies on horizontal mounting hardware to couple the modified anchor directly to the drum shell and vertical mounting hardware to couple the modified anchor to the top and bottom drum hoops or shell mounts. FIG. 34 illustrates the adapted lug holder with the modified anchor assembled with complete horizontal mounting hardware and vertical mounting hardware in accordance with some embodiments.

Figure 35:
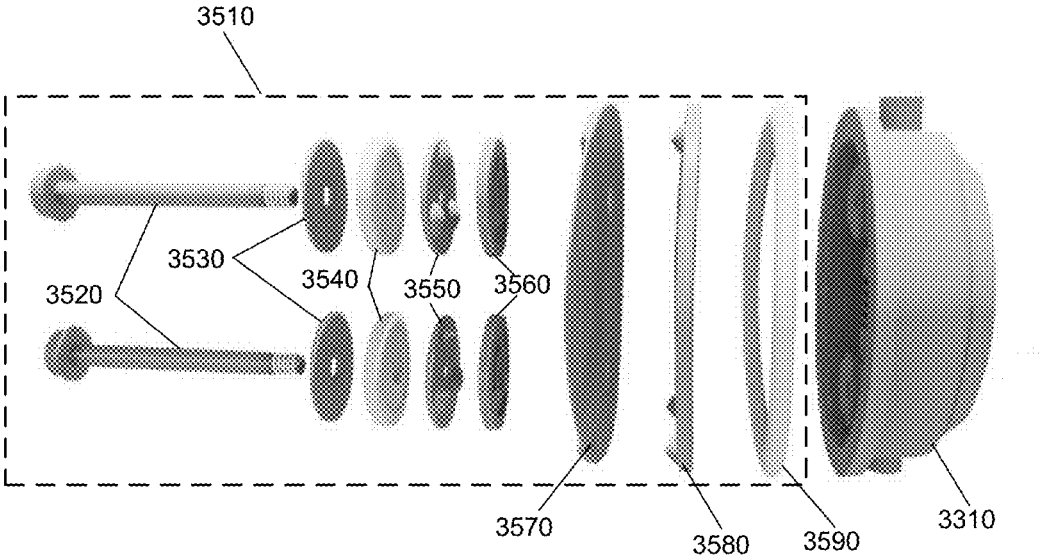
FIG. 35 illustrates the horizontal mounting hardware for coupling the modified anchor to the drum shell in accordance with some embodiments.

FIG. 35 illustrates the horizontal mounting hardware 3510 for coupling the modified anchor 3310 to the drum shell in accordance with some embodiments. The modified anchor 3310 includes two horizontal inner threaded cavities about its inside face for receiving the horizontal mounting hardware 3510.

As shown in FIG. 35, the horizontal mounting hardware 3510 for the adapted lug holder assembly that directly couples to the drum shell are very much similar to the mounting hardware used for the enhanced lug holder assembly of FIGS. 22-29 that couples to the modified tension ring vertical brackets. As before, the horizontal mounting hardware 3510 includes a pair of horizontal mounting bolts 3520, a pair of mounting washers/spacers 3530, a pair of mounting dampeners 3540, a pair of mounting gripped endcaps 3550, and a pair of isolation washers/spacers 3560 are positioned with relation to the order in which they are mounted on the inside of the drum shell over apertures about the drum shell. To rest flush against the drum shell, these components may be shaped according to the drum shell shape, thereby having a convex shape in some embodiments. The horizontal mounting hardware 3510 further include the anchor plate 3570, anchor gripped endcap 3580, and anchor dampener 3590 that are positioned on the outside of the drum shell over the same apertures. Here again, these components 3570, 3580, 3590, along with the anchor 3310 may be shaped according to the drum shell shape, thereby having a concave shape in some embodiments. The horizontal mounting hardware provides the energy isolation and dampening that minimize or eliminate energy transfer from the adapted lug holder assembly to the drum shell. The primary difference between the inner and outer components is the size of the structural elements. The outer components 3570, 3580, and 3590 are larger and they each share the same overall shape as the anchor 3310. In some embodiments, the shaft of each mounting bolt 3520 is elongated to provide sufficient length for each bolt shaft to pass through the elements 3530, 3540, 3550, and 3560 placed inside the drum shell, the aperture about the drum shell, and the elements 3570, 3580, and 3590 placed outside of the drum shell before screwing into the horizontal threaded cavity of the anchor 3310. Similar to the horizontal extenders 3110 shown in FIGS. 30-32, the adapted anchor 3310 shown in FIGS. 33, 34, 35 and 36 illustrate an adapted anchor 3310 that is elongated along the front face of the anchor. This raised portion of the anchor occupies the same space as the vertical brackets 2420 found on the modified tension ring 2410 and used with the enhanced lug holder anchor 2210 of FIGS. 22-29. In addition, the anchor dampener 3590, the anchor gripped endcap 3580, and the anchor plate 3570, shown in FIG. 35, extend the adapted anchor 3310 outward away from the radial exterior surface of the drum shell. These combined elements align the outer threading of the upper and lower vertical tension bolts 3610 with the inner threading of the upward and downward pointing swivel nuts 3620, that are inset in the non-threaded vertical apertures 3640 in the adapted anchor 3310, so that the upper and lower vertical tension bolts 3610 can screw into the swivel nuts 3620 in order to secure the top and bottom drum hoop (each containing a drumhead) to the drum shell.

Directly coupling the adapted lug holder assembly in FIG. 35 to the drum shell involves positioning the extrusions on one side of the pair of isolation washers/spacers 3560 to face an opening along the interior side of drum shell, wherein the drum shell opening is aligned with a horizontal cavity of the anchor 3310. The small round recesses on the opposite side of the pair of isolation washers/spacers 3560 provide a guide for the prongs on the pair of mounting gripped endcaps 3550 that abut the isolation washers/spacers 3560. The mounting dampeners 3540 are positioned to abut the mounting gripped endcaps 3550, along the side that has no prongs, and the mounting washers/spacers 3530 are positioned to abut the mounting dampeners 3540. Moreover, directly coupling the adapted lug holder assembly in FIG. 35 to the drum shell also involves positioning the extrusions on one side of the anchor plate 3570 to an opening along the exterior side of the drum shell, wherein the drum shell opening is aligned with a horizontal cavity of the anchor 3310. The prongs of the anchor gripped endcap 3580 abut recessed guides that are on the opposite side of the extrusions on the anchor plate 3570. The anchor dampener 3590 is positioned to abut the anchor gripped endcap 3580, along the side that has no prongs, and the anchor 3310 is positioned to abut the anchor dampeners 3590. The horizontal anchoring bolts 3520 are then passed from inside the drum shell through the positioned mounting hardware with the outer threading of the bolt 3520 screwing into the horizontal inner threaded cavities of the anchor 3310. It should be noted that the prongs found on the mounting gripped endcaps 3550 and the anchor gripped endcap 3580, shown in FIG. 35, reduce the potential for energy to transfer from the adapted lug holder anchor 3310 to the horizontal mounting hardware which abut the pronged endcaps 3550 and 3580 and compress the drum shell on the x-axis.

Figure 36:
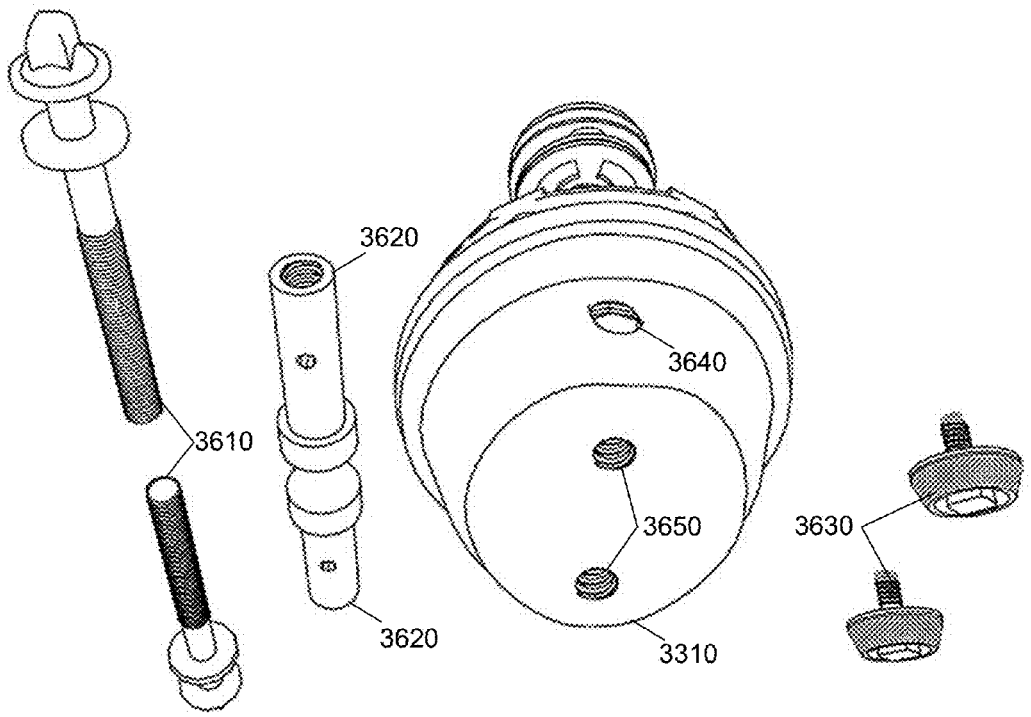
FIG. 36 illustrates the vertical mounting hardware for coupling the modified anchor to each of the top and bottom drum hoops or shell mounts in accordance with some embodiments.

FIG. 36 illustrates the vertical mounting hardware for coupling the modified anchor 3310 to each of the top and bottom drum hoops or shell mounts in accordance with some embodiments. The modified anchor 3310 includes a top vertical non-threaded aperture 3640 for receiving a first set of vertical mounting hardware used in coupling the top drum hoop or top shell mount to the anchor 3310 and a bottom vertical non-threaded aperture (not shown) for receiving a second set of vertical mounting hardware used in coupling the bottom drum hoop or bottom shell mount to the anchor 3310. Horizontal inner threaded apertures about the outside face of the anchor 3310 receive lockdown bolts 3630 to secure the position of the vertical tension bolts 3610 in the swivel nuts 3620 inset in the anchor 3310.

The vertical mounting hardware includes a pair of vertical tension bolts 3610, a pair of swivel nuts 3620, and a pair of lockdown bolts 3630. The swivel nuts 3620 contain inner threading for receiving the outer threads of the vertical tension bolts 3610. Each vertical tension bolt 3610 passes through an extruded opening (see reference marker 3350 from FIG. 33) extending along the outer vertical face of the drum hoop. Then the outer threading of the vertical tension bolt 3610 screws into the inner threading of either the top or bottom swivel nut 3620 that is inset in the anchor 3310. The lockdown bolts 3630 secure the position of either the top or bottom vertical tension bolt 3610 that is screwed into either the top or bottom swivel nut 3620 inset within the anchor 3610. More specifically, the outer threading of either lockdown bolt 3630, screws into either of the pair of inner threaded apertures 3650 in the outer face of the anchor 3310. As shown in FIG. 36, the top and bottom swivel nuts 3620 each contain a non-threaded aperture that is along one side of their shaft. The non-threaded apertures allow the outer threading of each of the top and bottom lockdown bolts 3630 to pass through so that the tips of these lockdown bolts 3630 can make contact with the outer threading of the top and bottom vertical tension bolts 3610. To facilitate this, the non-threaded apertures of the top and bottom swivel nuts 3620 are aligned with the anchor's top and bottom inner threaded aperture 3650 located in outside face of the anchor 3310. Moreover, as shown by FIG. 36, the outer threading of the pair of top and bottom lockdown bolts 3630 screws into the top and bottom inner threading apertures 3650 within the outside face of the anchor 3310, thereby imposing a horizontal force on the outer threading of the pair of vertical tension bolts 3610 that prevents further rotational movement of either the top or bottom vertical tension bolts 3610. The lockdown bolts 3630 may include Teflon in the tip or other material so as to prevent damage to the outer threading of the vertical tension bolts 3610 upon contact.

Accordingly, the adapted lug holder assemblies (with or without the modified anchor) depicted in FIGS. 30-36 can be used to couple the drumhead to the drum shell without a separate structural framework such as the ultimount structural framework. The adapted lug holder assemblies continue to provide energy dampening benefits over lug holders of the prior art. Specifically, the adapted lug holder assemblies of some embodiments, by way of the dampeners positioned on either side of the drum shell, minimize the amount of energy that transfers from the drumhead and drum shell into the lug holders. This reduces or eliminates unwanted sound distortions that would otherwise result from the lug holders rattling during drum playing, while at the same time increases the resonating potential of the drum shell. It should be noted that the shape of the adapted lug holder anchor, shown in FIGS. 30-36, can be manufactured to mimic the shape of many of the casings in which many of the existing lug holder anchors/casings of the prior art are manufactured. The mounting footprint for the adapted lug holder anchors is shown as the vertical distance between the two horizontal mounting anchor bolts 3210 (FIG. 32) and 3520 (FIG. 35). In addition, the placement in which the adapted lug holder is attached to the drum shell is shown as the distance that the horizontal mounting anchor bolts are placed from either the top or bottom edge of the drum shell. The adapted lug holder anchors shown in FIGS. 30-36, are universally compatible with existing lug holder anchors of the prior art for mounting and placing onto the drum shell. This allows the adapted lug holder anchor and the adapted lug holder mounting hardware, listed herein, to serve as a drop-in replacement for a variety of existing lug holder anchors of the prior art without any need to modify the adapted lug holder anchor, the adapted lug holder mounting hardware, or the drum shell. This substitution would not be intended to misbrand the aesthetics of any proprietary (branded) existing lug holder casing shape of the prior art, for which any drum manufacturers might be known for.

I claim:

1. An energy dampening lug holder for a drum, the lug holder comprising:

an anchor comprising a body with a threaded vertical cavity and a first threaded horizontal cavity vertically separated from a second threaded horizontal cavity about a common side of the anchor;

a first bolt with exterior threading coupling said anchor to a first drum structure by passing through an aperture of the first drum structure and screwing into the threaded vertical cavity; and first and second sets of mounting hardware coupling the anchor to a different second drum structure, each of the first and second sets of mounting hardware comprising a pair of energy dampeners and a second bolt with exterior threading securing the pair of dampeners against opposing sides of the second drum structure by screwing into one of the first threaded horizontal cavity and the second threaded horizontal cavity.

2. The lug holder of claim 1, wherein each of the first and second sets of mounting hardware further comprises a pair of endcaps, the endcaps comprising a plurality of protrusions that minimize surface contact between the endcaps and the second drum structure when the endcaps are positioned between the dampeners and the second drum structure with the plurality of protrusions facing the second drum structure.

3. The lug holder of claim 1, wherein the second drum structure is not a drum shell.

4. The lug holder of claim 3, wherein the first drum structure is a die-cast hoop containing a drumhead and the second drum structure is a tension ring positioned between the die-cast hoop and the drum shell.

5. The lug holder of claim 1, wherein the second drum structure is a drum shell comprising at least one opening through which the second bolt passes.

6. The lug holder of claim 1, wherein the anchor further comprises an aperture on a backside of the anchor that is opposite a frontside where said first and second threaded horizontal cavities are disposed.

7. The lug holder of claim 6 further comprising a lockdown bolt fixing a position of the first bolt within the threaded vertical cavity by screwing into said aperture and contacting said first bolt laterally within the threaded vertical cavity.

8. A mounting system comprising:

a die-cast hoop containing a drumhead, the die-cast hoop comprising a plurality of vertical facing apertures about an outer circumference of the die-cast hoop;

a tension ring for mounting over one end of a drum shell, the tension ring comprising a plurality of brackets extending vertically from an outer circumference of the tension ring; and a plurality of lug holder assemblies, each lug holder assembly of the plurality of lug holder assemblies comprising (i) an anchor with a horizontal cavity and a vertical cavity, (ii) a pair of vibration absorbing dampeners, (iii) a first bolt coupling said anchor to the die-cast hoop by passing through an aperture of the plurality of apertures and screwing into the vertical cavity, and (iv) a second bolt coupling said anchor to the tension ring by positioning the pair of vibration absorbing dampeners along either side of a bracket of the plurality of brackets, inserting the second bolt through the pair of vibration absorbing dampeners and the bracket, and screwing the second bolt into the horizontal cavity.

9. The mounting system of claim 8, wherein each lug holder assembly further comprises an endcap having a plurality of protrusions, the endcap positioned between a vibration absorbing dampener and the bracket with the plurality of protrusions abutting the bracket so as to reduce surface contact with the bracket.

10. The mounting system of claim 8, wherein the plurality of lug holder assemblies when coupled to the plurality of brackets do not contact the drum shell.

11. The mounting system of claim 8 further comprising a drum shell that does not contain any holes across its outer face, and wherein the tension ring is adapted to couple to a top end or a bottom end of the drum shell.

12. The mounting system of claim 8, wherein the tension ring further comprises a bearing edge groove for holding an interchangeable bearing edge.

13. The mounting system of claim 12 further comprising a plurality of bearing edges that are each cut at different angles, each bearing edge angle altering drum tonality when inset within the bearing edge groove.

14. The mounting system of claim 8, wherein the anchor horizontal cavity is a first horizontal cavity, the anchor further comprising a second horizontal cavity at an opposite side of the anchor relative to the first horizontal cavity.

15. The mounting system of claim 14 further comprising a lockdown bolt fixing a position of the first bolt within the anchor vertical cavity by screwing into said second horizontal cavity and contacting said first bolt laterally within the vertical cavity.

16. A mounting system comprising:

a drum shell comprising a cylindrical body with at least one aperture along the cylindrical body;

a drum shell mount comprising a drumhead and a plurality of vertical facing apertures about an outer circumference of the drum shell mount; and a plurality of lug holder assemblies coupling the drum shell mount to the drum shell with a user specified amount of force, each lug holder assembly of the plurality of lug holder assemblies comprising (i) an anchor with a threaded horizontal cavity and a threaded vertical cavity, (ii) a pair of vibration absorbing dampeners, (iii) a first bolt coupling said anchor to the drum shell by passing from within the drum shell body through a first dampener of the pair of vibration absorbing dampeners, the aperture, and a second dampener of the pair of vibration absorbing dampeners and screwing into the horizontal cavity, and (iv) a second bolt coupling said anchor to the drum shell mount by passing through an aperture of the plurality of vertical facing apertures and screwing into the vertical cavity, and wherein the pair of vibration absorbing dampeners reduce energy transfer from the drum shell to the each lug holder assembly preserving a pure drum sound.

17. The mounting system of claim 16, wherein the anchor horizontal cavity is a first horizontal cavity, the anchor further comprising a second horizontal cavity at an opposite side of the anchor relative to the first horizontal cavity.

18. The mounting system of claim 17 further comprising a lockdown bolt fixing a position of the second bolt within the anchor vertical cavity by screwing into said second horizontal cavity and contacting said second bolt laterally within the vertical cavity.

* * * * *